US010586491B2

(12) United States Patent
Chaji et al.

(10) Patent No.: US 10,586,491 B2
(45) Date of Patent: Mar. 10, 2020

(54) PIXEL CIRCUITS FOR MITIGATION OF HYSTERESIS

(71) Applicant: Ignis Innovation Inc., Waterloo (CA)

(72) Inventors: Gholamreza Chaji, Waterloo (CA); Yaser Azizi, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 267 days.

(21) Appl. No.: 15/832,962

(22) Filed: Dec. 6, 2017

(65) Prior Publication Data

US 2018/0158415 A1 Jun. 7, 2018

Related U.S. Application Data

(60) Provisional application No. 62/430,437, filed on Dec. 6, 2016.

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0861* (2013.01); *G09G 2310/0251* (2013.01); *G09G 2310/0262* (2013.01); *G09G 2320/0209* (2013.01); *G09G 2320/0295* (2013.01); *G09G 2320/0693* (2013.01)

(58) Field of Classification Search
CPC ..... G09G 2300/0842; G09G 3/3291; G09G 2300/0417
See application file for complete search history.

(56) References Cited

U.S. PATENT DOCUMENTS

| | | | |
|---|---|---|---|
| 4,354,162 | A | 10/1982 | Wright |
| 4,758,831 | A | 7/1988 | Kasahara et al. |
| 4,963,860 | A | 10/1990 | Stewart |
| 4,975,691 | A | 12/1990 | Lee |
| 4,996,523 | A | 2/1991 | Bell et al. |
| 5,051,739 | A | 9/1991 | Hayashida et al. |
| 5,222,082 | A | 6/1993 | Plus |
| 5,266,515 | A | 11/1993 | Robb et al. |
| 5,498,880 | A | 3/1996 | Lee et al. |
| 5,589,847 | A | 12/1996 | Lewis |

(Continued)

FOREIGN PATENT DOCUMENTS

| | | |
|---|---|---|
| CA | 1294034 | 1/1992 |
| CA | 2109951 | 11/1992 |

(Continued)

OTHER PUBLICATIONS

Ahnood et al.: "Effect of threshold voltage instability on field effect mobility in thin film transistors deduced from constant current measurements"; dated Aug. 2009 (3 pages).

(Continued)

*Primary Examiner* — Van N Chow
(74) *Attorney, Agent, or Firm* — Stratford Managers Corporation

(57) ABSTRACT

What is disclosed are display systems and methods of compensation of images produced by active matrix light emitting diode device (AMOLED) and other emissive displays. Anomalies in luminance produced by pixel circuits due to hysteresis effects are corrected through in-pixel compensation and resetting of the driving transistor.

22 Claims, 10 Drawing Sheets

(56) References Cited

U.S. PATENT DOCUMENTS 5,619,033 A 4/1997 Weisfield
5,648,276 A 7/1997 Hara et al.
5,670,973 A 9/1997 Bassetti et al.
5,684,365 A 11/1997 Tang et al.
5,686,935 A 11/1997 Weisbrod
5,712,653 A 1/1998 Katoh et al.
5,714,968 A 2/1998 Ikeda
5,747,928 A 5/1998 Shanks et al.
5,748,160 A 5/1998 Shieh et al.
5,784,042 A 7/1998 Ono et al.
5,790,234 A 8/1998 Matsuyama
5,815,303 A 9/1998 Berlin
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,923,794 A 7/1999 McGrath et al.
5,952,789 A 9/1999 Stewart et al.
5,990,629 A 11/1999 Yamada et al.
6,023,259 A 2/2000 Howard et al.
6,069,365 A 5/2000 Chow et al.
6,081,131 A 6/2000 Ishii
6,091,203 A 7/2000 Kawashima et al.
6,097,360 A 8/2000 Holloman
6,144,222 A 11/2000 Ho
6,157,583 A 12/2000 Starnes et al.
6,166,489 A 12/2000 Thompson et al.
6,177,915 B1 1/2001 Beeteson et al.
6,225,846 B1 5/2001 Wada et al.
6,229,508 B1 5/2001 Kane
6,232,939 B1 5/2001 Saito et al.
6,246,180 B1 6/2001 Nishigaki
6,252,248 B1 6/2001 Sano et al.
6,259,424 B1 7/2001 Kurogane
6,274,887 B1 8/2001 Yamazaki et al.
6,288,696 B1 9/2001 Holloman
6,300,928 B1 10/2001 Kim
6,303,963 B1 10/2001 Ohtani et al.
6,306,694 B1 10/2001 Yamazaki et al.
6,307,322 B1 10/2001 Dawson et al.
6,316,786 B1 11/2001 Mueller et al.
6,320,325 B1 11/2001 Cok et al.
6,323,631 B1 11/2001 Juang
6,323,832 B1 11/2001 Nishizawa et al.
6,345,085 B1 2/2002 Yeo et al.
6,348,835 B1 2/2002 Sato et al.
6,365,917 B1 4/2002 Yamazaki
6,373,453 B1 4/2002 Yudasaka
6,384,427 B1 5/2002 Yamazaki et al.
6,392,617 B1 5/2002 Gleason
6,399,988 B1 6/2002 Yamazaki
6,414,661 B1 7/2002 Shen et al.
6,420,758 B1 7/2002 Nakajima
6,420,834 B2 7/2002 Yamazaki et al.
6,420,988 B1 7/2002 Azami et al.
6,433,488 B1 8/2002 Bu
6,445,376 B2 9/2002 Parrish
6,468,638 B2 10/2002 Jacobsen et al.
6,489,952 B1 12/2002 Tanaka et al.
6,501,098 B2 12/2002 Yamazaki
6,501,466 B1 12/2002 Yamagashi et al.
6,512,271 B1 1/2003 Yamazaki et al.
6,518,594 B1 2/2003 Nakajima et al.
6,524,895 B2 2/2003 Yamazaki et al.
6,531,713 B1 3/2003 Yamazaki
6,559,594 B2 5/2003 Fukunaga et al.
6,573,195 B1 6/2003 Yamazaki et al.
6,573,584 B1 6/2003 Nagakari et al.
6,576,926 B1 6/2003 Yamazaki et al.
6,577,302 B2 6/2003 Hunter
6,580,408 B1 6/2003 Bae et al.
6,580,657 B2 6/2003 Sanford et al.
6,583,775 B1 6/2003 Sekiya et al.
6,583,776 B2 6/2003 Yamazaki et al.
6,587,086 B1 7/2003 Koyama
6,593,691 B2 7/2003 Nishi et al.
6,594,606 B2 7/2003 Everitt
6,597,203 B2 7/2003 Forbes
6,611,108 B2 8/2003 Kimura
6,617,644 B1 9/2003 Yamazaki et al.
6,618,030 B2 9/2003 Kane et al.
6,641,933 B1 11/2003 Yamazaki et al.
6,661,180 B2 12/2003 Koyama
6,661,397 B2 12/2003 Mikami et al.
6,670,637 B2 12/2003 Yamazaki et al.
6,677,713 B1 1/2004 Sung
6,680,577 B1 1/2004 Inukai et al.
6,687,266 B1 2/2004 Ma et al.
6,690,344 B1 2/2004 Takeuchi et al.
6,693,388 B2 2/2004 Oomura
6,693,610 B2 2/2004 Shannon et al.
6,697,057 B2 2/2004 Koyama et al.
6,720,942 B2 4/2004 Lee et al.
6,734,636 B2 5/2004 Sanford et al.
6,738,034 B2 5/2004 Kaneko et al.
6,738,035 B1 5/2004 Fan
6,771,028 B1 8/2004 Winters
6,777,712 B2 8/2004 Sanford et al.
6,780,687 B2 8/2004 Nakajima et al.
6,806,638 B2 10/2004 Lih et al.
6,806,857 B2 10/2004 Sempel et al.
6,809,706 B2 10/2004 Shimoda
6,859,193 B1 2/2005 Yumoto
6,861,670 B1 3/2005 Ohtani et al.
6,873,117 B2 3/2005 Ishizuka
6,873,320 B2 3/2005 Nakamura
6,878,968 B1 4/2005 Ohnuma
6,909,114 B1 6/2005 Yamazaki
6,909,419 B2 6/2005 Zavracky et al.
6,919,871 B2 7/2005 Kwon
6,937,215 B2 8/2005 Lo
6,940,214 B1 9/2005 Komiya et al.
6,943,500 B2 9/2005 LeChevalier
6,954,194 B2 10/2005 Matsumoto et al.
6,956,547 B2 10/2005 Bae et al.
6,995,510 B2 2/2006 Murakami et al.
6,995,519 B2 2/2006 Arnold et al.
7,022,556 B1 4/2006 Adachi
7,023,408 B2 4/2006 Chen et al.
7,027,015 B2 4/2006 Booth, Jr. et al.
7,034,793 B2 4/2006 Sekiya et al.
7,088,051 B1 8/2006 Cok
7,106,285 B2 9/2006 Naugler
7,116,058 B2 10/2006 Lo et al.
7,129,914 B2 10/2006 Knapp et al.
7,129,917 B2 10/2006 Yamazaki et al.
7,141,821 B1 11/2006 Yamazaki et al.
7,161,566 B2 1/2007 Cok et al.
7,193,589 B2 3/2007 Yoshida et al.
7,199,516 B2 4/2007 Seo et al.
7,220,997 B2 5/2007 Nakata
7,235,810 B1 6/2007 Yamazaki et al.
7,245,277 B2 7/2007 Ishizuka
7,248,236 B2 7/2007 Nathan et al.
7,264,979 B2 9/2007 Yamagata et al.
7,274,345 B2 9/2007 Imamura et al.
7,274,363 B2 9/2007 Ishizuka et al.
7,279,711 B1 10/2007 Yamazaki et al.
7,304,621 B2 12/2007 Oomori et al.
7,310,092 B2 12/2007 Imamura
7,315,295 B2 1/2008 Kimura
7,317,429 B2 1/2008 Shirasaki et al.
7,319,465 B2 1/2008 Mikami et al.
7,321,348 B2 1/2008 Cok et al.
7,339,636 B2 3/2008 Voloschenko et al.
7,355,574 B1 4/2008 Leon et al.
7,358,941 B2 4/2008 Ono et al.
7,402,467 B1 7/2008 Kadono et al.
7,414,600 B2 8/2008 Nathan et al.
7,432,885 B2 10/2008 Asano et al.
7,474,285 B2 1/2009 Kimura
7,485,478 B2 2/2009 Yamagata et al.
7,502,000 B2 3/2009 Yuki et al.

(56) References Cited

U.S. PATENT DOCUMENTS 7,535,449 B2 5/2009 Miyazawa
7,554,512 B2 6/2009 Steer
7,569,849 B2 8/2009 Nathan et al.
7,619,594 B2 11/2009 Hu
7,619,597 B2 11/2009 Nathan et al.
7,697,052 B1 4/2010 Yamazaki et al.
7,825,419 B2 11/2010 Yamagata et al.
7,859,492 B2 12/2010 Kohno
7,868,859 B2 1/2011 Tomida et al.
7,876,294 B2 1/2011 Sasaki et al.
7,948,170 B2 5/2011 Striakhilev et al.
7,948,456 B2 * 5/2011 Yamashita ..... G09G 3/3233 315/169.1
7,969,390 B2 6/2011 Yoshida
7,995,010 B2 8/2011 Yamazaki et al.
8,044,893 B2 10/2011 Nathan et al.
8,115,707 B2 2/2012 Nathan et al.
8,378,362 B2 2/2013 Heo et al.
8,493,295 B2 7/2013 Yamazaki et al.
8,497,525 B2 7/2013 Yamagata et al.
9,385,169 B2 7/2016 Chaji et al.
9,606,607 B2 3/2017 Chaji
9,633,597 B2 4/2017 Nathan et al.
9,728,135 B2 8/2017 Nathan et al.
9,741,292 B2 8/2017 Nathan et al.
2001/0002703 A1 6/2001 Koyama
2001/0004190 A1 6/2001 Nishi et al.
2001/0013806 A1 8/2001 Notani
2001/0015653 A1 8/2001 De Jong et al.
2001/0020926 A1 9/2001 Kujik
2001/0024186 A1 9/2001 Kane
2001/0026127 A1 10/2001 Yoneda et al.
2001/0026179 A1 10/2001 Saeki
2001/0026257 A1 10/2001 Kimura
2001/0030323 A1 10/2001 Ikeda
2001/0033199 A1 10/2001 Aoki
2001/0038098 A1 11/2001 Yamazaki et al.
2001/0043173 A1 11/2001 Troutman
2001/0045929 A1 11/2001 Prache et al.
2001/0052006 A1 12/2001 Sempel et al.
2001/0052898 A1 12/2001 Osame et al.
2002/0000576 A1 1/2002 Inukai
2002/0011796 A1 1/2002 Koyama
2002/0011799 A1 1/2002 Kimura
2002/0011981 A1 1/2002 Kujik
2002/0015031 A1 2/2002 Fujita et al.
2002/0015032 A1 2/2002 Koyama et al.
2002/0030528 A1 3/2002 Matsumoto et al.
2002/0030647 A1 3/2002 Hack et al.
2002/0036463 A1 3/2002 Yoneda et al.
2002/0047852 A1 4/2002 Inukai et al.
2002/0048829 A1 4/2002 Yamazaki et al.
2002/0050795 A1 5/2002 Imura
2002/0053401 A1 5/2002 Ishikawa et al.
2002/0070909 A1 6/2002 Asano et al.
2002/0080108 A1 6/2002 Wang
2002/0084463 A1 7/2002 Sanford et al.
2002/0101172 A1 8/2002 Bu
2002/0101433 A1 8/2002 McKnight
2002/0113248 A1 8/2002 Yamagata et al.
2002/0122308 A1 9/2002 Ikeda
2002/0130686 A1 9/2002 Forbes
2002/0154084 A1 10/2002 Tanaka et al.
2002/0158823 A1 10/2002 Zavracky et al.
2002/0163314 A1 11/2002 Yamazaki et al.
2002/0167471 A1 11/2002 Everitt
2002/0180369 A1 12/2002 Koyama
2002/0180721 A1 12/2002 Kimura et al.
2002/0186214 A1 12/2002 Siwinski
2002/0190332 A1 12/2002 Lee et al.
2002/0190924 A1 12/2002 Asano et al.
2002/0190971 A1 12/2002 Nakamura et al.
2002/0195967 A1 12/2002 Kim et al.
2002/0195968 A1 12/2002 Sanford et al.
2003/0020413 A1 1/2003 Oomura
2003/0030603 A1 2/2003 Shimoda
2003/0062524 A1 4/2003 Kimura
2003/0063081 A1 4/2003 Kimura et al.
2003/0071804 A1 4/2003 Yamazaki et al.
2003/0071821 A1 4/2003 Sundahl
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0107560 A1 6/2003 Yumoto et al.
2003/0111966 A1 6/2003 Mikami et al.
2003/0122745 A1 7/2003 Miyazawa
2003/0140958 A1 7/2003 Yang et al.
2003/0151569 A1 8/2003 Lee et al.
2003/0169219 A1 9/2003 LeChevalier
2003/0174152 A1 9/2003 Noguchi
2003/0178617 A1 9/2003 Appenzeller et al.
2003/0179626 A1 9/2003 Sanford et al.
2003/0197663 A1 10/2003 Lee et al.
2003/0206060 A1 11/2003 Suzuki
2003/0230980 A1 12/2003 Forrest et al.
2004/0027063 A1 2/2004 Nishikawa
2004/0056604 A1 3/2004 Shih et al.
2004/0066357 A1 4/2004 Kawasaki
2004/0070557 A1 4/2004 Asano et al.
2004/0080262 A1 4/2004 Park et al.
2004/0080470 A1 4/2004 Yamazaki et al.
2004/0090400 A1 5/2004 Yoo
2004/0108518 A1 6/2004 Jo
2004/0113903 A1 6/2004 Mikami et al.
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150592 A1 8/2004 Mizukoshi et al.
2004/0150594 A1 8/2004 Koyama et al.
2004/0150595 A1 8/2004 Kasai
2004/0155841 A1 8/2004 Kasai
2004/0174347 A1 9/2004 Sun et al.
2004/0174349 A1 9/2004 Libsch
2004/0183759 A1 9/2004 Stevenson et al.
2004/0189627 A1 9/2004 Shirasaki et al.
2004/0196275 A1 10/2004 Hattori
2004/0201554 A1 10/2004 Satoh
2004/0207615 A1 10/2004 Yumoto
2004/0233125 A1 11/2004 Tanghe et al.
2004/0239596 A1 12/2004 Ono et al.
2004/0252089 A1 12/2004 Ono et al.
2004/0257355 A1 12/2004 Naugler
2004/0263437 A1 12/2004 Hattori
2005/0007357 A1 1/2005 Yamashita et al.
2005/0030267 A1 2/2005 Tanghe et al.
2005/0035709 A1 2/2005 Furuie et al.
2005/0067970 A1 3/2005 Libsch et al.
2005/0067971 A1 3/2005 Kane
2005/0068270 A1 3/2005 Awakura
2005/0088085 A1 4/2005 Nishikawa et al.
2005/0088103 A1 4/2005 Kageyama et al.
2005/0110420 A1 5/2005 Arnold et al.
2005/0117096 A1 6/2005 Voloschenko et al.
2005/0140598 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0225686 A1 10/2005 Brummack et al.
2005/0260777 A1 11/2005 Brabec et al.
2005/0269959 A1 12/2005 Uchino et al.
2005/0269960 A1 12/2005 Ono et al.
2005/0285822 A1 12/2005 Reddy et al.
2005/0285825 A1 12/2005 Eom et al.
2006/0007072 A1 1/2006 Choi et al.
2006/0012310 A1 1/2006 Chen et al.
2006/0027807 A1 2/2006 Nathan et al.
2006/0030084 A1 2/2006 Young
2006/0038758 A1 2/2006 Routley et al.
2006/0044227 A1 3/2006 Hadcock

(56) References Cited

U.S. PATENT DOCUMENTS

| | | | | |
|---|---|---|---|---|
| 2006/0066527 | A1 | 3/2006 | Chou | |
| 2006/0092185 | A1 | 5/2006 | Jo et al. | |
| 2006/0232522 | A1 | 10/2006 | Roy et al. | |
| 2006/0261841 | A1 | 11/2006 | Fish | |
| 2006/0264143 | A1 | 11/2006 | Lee et al. | |
| 2006/0273997 | A1 | 12/2006 | Nathan et al. | |
| 2006/0284801 | A1 | 12/2006 | Yoon et al. | |
| 2007/0001937 | A1 | 1/2007 | Park et al. | |
| 2007/0001939 | A1 | 1/2007 | Hashimoto et al. | |
| 2007/0008268 | A1 | 1/2007 | Park et al. | |
| 2007/0008297 | A1 | 1/2007 | Bassetti | |
| 2007/0046195 | A1 | 3/2007 | Chin et al. | |
| 2007/0069998 | A1 | 3/2007 | Naugler et al. | |
| 2007/0080905 | A1 | 4/2007 | Takahara | |
| 2007/0080906 | A1 | 4/2007 | Tanabe | |
| 2007/0080908 | A1 | 4/2007 | Nathan et al. | |
| 2007/0080918 | A1 | 4/2007 | Kawachi et al. | |
| 2007/0103419 | A1 | 5/2007 | Uchino et al. | |
| 2007/0182671 | A1 | 8/2007 | Nathan et al. | |
| 2007/0273294 | A1 | 11/2007 | Nagayama | |
| 2007/0285359 | A1 | 12/2007 | Ono | |
| 2007/0296672 | A1 | 12/2007 | Kim et al. | |
| 2008/0012835 | A1 | 1/2008 | Rimon et al. | |
| 2008/0042948 | A1 | 2/2008 | Yamashita et al. | |
| 2008/0055209 | A1 | 3/2008 | Cok | |
| 2008/0074413 | A1 | 3/2008 | Ogura | |
| 2008/0088549 | A1 | 4/2008 | Nathan et al. | |
| 2008/0122803 | A1 | 5/2008 | Izadi et al. | |
| 2008/0230118 | A1 | 9/2008 | Nakatani et al. | |
| 2009/0032807 | A1 | 2/2009 | Shinohara et al. | |
| 2009/0051283 | A1 | 2/2009 | Cok et al. | |
| 2009/0160743 | A1 | 6/2009 | Tomida et al. | |
| 2009/0162961 | A1 | 6/2009 | Deane | |
| 2009/0174628 | A1 | 7/2009 | Wang et al. | |
| 2009/0179838 | A1* | 7/2009 | Yamashita ..... | G09G 3/3233 345/84 |
| 2009/0213046 | A1 | 8/2009 | Nam | |
| 2010/0039422 | A1* | 2/2010 | Seto ..... | G09G 3/3233 345/212 |
| 2010/0052524 | A1 | 3/2010 | Kinoshita | |
| 2010/0078230 | A1 | 4/2010 | Rosenblatt et al. | |
| 2010/0079711 | A1 | 4/2010 | Tanaka | |
| 2010/0097335 | A1 | 4/2010 | Jung et al. | |
| 2010/0133994 | A1 | 6/2010 | Song et al. | |
| 2010/0134456 | A1 | 6/2010 | Oyamada | |
| 2010/0140600 | A1 | 6/2010 | Clough et al. | |
| 2010/0156279 | A1 | 6/2010 | Tamura et al. | |
| 2010/0237374 | A1 | 9/2010 | Chu et al. | |
| 2010/0328294 | A1 | 12/2010 | Sasaki et al. | |
| 2011/0090210 | A1 | 4/2011 | Sasaki et al. | |
| 2011/0133636 | A1 | 6/2011 | Matsuo et al. | |
| 2011/0148801 | A1 | 6/2011 | Bateman et al. | |
| 2011/0180825 | A1 | 7/2011 | Lee et al. | |
| 2012/0212468 | A1 | 8/2012 | Govil | |
| 2013/0009930 | A1 | 1/2013 | Cho et al. | |
| 2013/0032831 | A1 | 2/2013 | Chaji et al. | |
| 2013/0113785 | A1 | 5/2013 | Sumi | |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 436 451 | | 8/2002 |
| CA | 2 438 577 | | 8/2002 |
| CA | 2 483 645 | | 12/2003 |
| CA | 2 463 653 | | 1/2004 |
| CA | 2498136 | | 3/2004 |
| CA | 2522396 | | 11/2004 |
| CA | 2443206 | | 3/2005 |
| CA | 2472671 | | 12/2005 |
| CA | 2567076 | | 1/2006 |
| CA | 2526782 | | 4/2006 |
| CN | 1381032 | | 11/2002 |
| CN | 1448908 | | 10/2003 |
| CN | 1776922 | | 5/2006 |
| CN | 101032027 | A | 9/2007 |
| CN | 101256293 | A | 9/2008 |
| CN | 101727237 | A | 6/2010 |
| CN | 102799331 | A | 11/2012 |
| CN | 102955600 | A | 3/2013 |
| DE | 20 2006 005427 | | 6/2006 |
| EP | 0 940 796 | | 9/1999 |
| EP | 1 028 471 | A | 8/2000 |
| EP | 1 103 947 | | 5/2001 |
| EP | 1 130 565 | A1 | 9/2001 |
| EP | 1 184 833 | | 3/2002 |
| EP | 1 194 013 | | 4/2002 |
| EP | 1 310 939 | | 5/2003 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 1 439 520 | | 7/2004 |
| EP | 1 465 143 | A | 10/2004 |
| EP | 1 467 408 | | 10/2004 |
| EP | 1 517 290 | | 3/2005 |
| EP | 1 521 203 | A2 | 4/2005 |
| EP | 2317499 | | 5/2011 |
| GB | 2 205 431 | | 12/1988 |
| JP | 09 090405 | | 4/1997 |
| JP | 10-153759 | | 6/1998 |
| JP | 10-254410 | | 9/1998 |
| JP | 11 231805 | | 8/1999 |
| JP | 11-282419 | | 10/1999 |
| JP | 2000/056847 | | 2/2000 |
| JP | 2000-077192 | | 3/2000 |
| JP | 2000-089198 | | 3/2000 |
| JP | 2000-352941 | | 12/2000 |
| JP | 2002-91376 | | 3/2002 |
| JP | 2002-268576 | | 9/2002 |
| JP | 2002-278513 | | 9/2002 |
| JP | 2002-333862 | | 11/2002 |
| JP | 2003-022035 | | 1/2003 |
| JP | 2003-076331 | | 3/2003 |
| JP | 2003-150082 | | 5/2003 |
| JP | 2003-177709 | | 6/2003 |
| JP | 2003-271095 | | 9/2003 |
| JP | 2003-308046 | | 10/2003 |
| JP | 2005-057217 | | 3/2005 |
| JP | 2006065148 | | 3/2006 |
| JP | 2009282158 | | 12/2009 |
| TW | 485337 | | 5/2002 |
| TW | 502233 | | 9/2002 |
| TW | 538650 | | 6/2003 |
| TW | 569173 | | 1/2004 |
| WO | WO 94/25954 | | 11/1994 |
| WO | WO 99/48079 | | 9/1999 |
| WO | WO 01/27910 | A1 | 4/2001 |
| WO | WO 02/067327 | A | 8/2002 |
| WO | WO 03/034389 | A | 4/2003 |
| WO | WO 03/063124 | | 7/2003 |
| WO | WO 03/077231 | | 9/2003 |
| WO | WO 03/105117 | | 12/2003 |
| WO | WO 2004/003877 | | 1/2004 |
| WO | WO 2004/034364 | | 4/2004 |
| WO | WO 2005/022498 | | 3/2005 |
| WO | WO 2005/029455 | | 3/2005 |
| WO | WO 2005/055185 | | 6/2005 |
| WO | WO 2006/053424 | | 5/2006 |
| WO | WO 2006/063448 | A | 6/2006 |
| WO | WO 2006/137337 | | 12/2006 |
| WO | WO 2007/003877 | A | 1/2007 |
| WO | WO 2007/079572 | | 7/2007 |
| WO | WO 2010/023270 | | 3/2010 |

OTHER PUBLICATIONS

Alexander et al.: "Pixel circuits and drive schemes for glass and elastic AMOLED displays"; dated Jul. 2005 (9 pages).

(56) References Cited

OTHER PUBLICATIONS

Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated My 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
European Search Report and Written Opinion for Application No. 08 86 5338 dated Nov. 2, 2011 (7 pages).
European Search Report for European Application No. EP 04 78 6661 dated Mar. 9, 2009.
European Search Report for European Application No. EP 05 75 9141 dated Oct. 30, 2009 .
European Search Report for European Application No. EP 05 82 1114 dated Mar. 27, 2009 (2 pages).
European Search Report for European Application No. EP 07 71 9579 dated May 20, 2009.
European Search Report dated Mar. 26, 2012 in corresponding European Patent Application No. 10000421.7 (6 pages).
Extended European Search Report dated Apr. 27, 2011 issued during prosecution of European patent application No. 09733076.5 (13 pages).
Goh et al., "A New a-Si:H Thin Film Transistor Pixel Circul for Active-Matrix Organic Light-Emitting Diodes", IEEE Electron Device Letters, vol. 24, No. 9, Sep. 2003, 4 pages.
International Search Report for International Application No. PCT/CA02/00180 dated Jul. 31, 2002 (3 pages).
International Search Report for International Application No. PCT/CA2004/001741 dated Feb. 21, 2005.
International Search Report for International Application No. PCT/CA2005/001844 dated Mar. 28, 2006 (2 pages).
International Search Report for International Application No. PCT/CA2005/001007 dated Oct. 18, 2005.
International Search Report for International Application No. PCT/CA2007/000652 dated Jul. 25, 2007.
International Search Report for International Application No. PCT/CA2008/002307, dated Apr. 28, 2009 (3 pages).
International Search Report for International Application No. PCT/IB2011/055135, Canadian Patent Office, dated Apr. 16, 2012 (5 pages).
International Search Report dated Jul. 30, 2009 for International Application No. PCT/CA2009/000501 (4 pages).
Jafarabadiashtiani et al.: "A New Driving Method for a-Si AMOLED Displays Based on Voltage Feedback"; dated 2005 (4 pages).
Lee et al.: "Ambipolar Thin-Film Transistors Fabricated by PECVD Nanocrystalline Silicon"; dated 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto, Sep. 15-19, 1997 (6 pages).
Matsueda y et al.: "35.1: 2.5-in. AMOLED with Integrated 6-bit Gamma Compensated Digital Data Driver"; dated May 2004.
Nathan et al.: "Backplane Requirements for Active Matrix Organic Light Emitting Diode Displays"; dated 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a -Si for AMOLED—Meeting the Performance and Cost Demands of Display Applications (Cell Phone to HDTV)"; dated 2006 (4 pages).
Nathan et al.: "Thin film imaging technology on glass and plastic" ICM 2000, Proceedings of the 12$^{th}$ International Conference on Microelectronics, (IEEE Cat. No. 00EX453), Tehran Iran; dated Oct. 31-Nov. 2, 2000, pp. 11-14, ISBN: 964-360-057-2, p. 13, col. 1, line 11-48; (4 pages).
Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Office Action issued in Chinese Patent Application 200910246264.4 dated Jul. 5, 2013; 8 pages.
Patent Abstracts of Japan, vol. 2000, No. 09, Oct. 13, 2000—JP 2000 172199 A, Jun. 3, 2000, abstract.
Patent Abstracts of Japan, vol. 2002, No. 03, Apr. 3, 2002 (Apr. 4, 2004 & JP 2001 318627 A (Semiconductor EnergyLab DO Ltd),

(56) References Cited

OTHER PUBLICATIONS

Nov. 16, 2001, abstract, paragraphs '01331-01801, paragraph '01691, paragraph '01701, paragraph '01721 and figure 10.
Philipp: "Charge transfer sensing" Sensor Review, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Sanford, James L., et al., "4.2 TFT AMOLED Pixel Circuits and Driving Methods", SID 03 Digest, ISSN/0003, 2003, pp. 10-13.
Stewart M. et al., "Polysilicon TFT technology for active matrix OLED displays" IEEE transactions on electron devices, vol. 48, No. 5; Dated May 2001 (7 pages).
Tatsuya Sasaoka et al., 24.4L; Late-News Paper: A 13.0-inch AM-Oled Display with Top Emitting Structure and Adaptive Current Mode Programmed Pixel Circuit (TAC), SID 01 Digest, (2001), pp. 384-387.
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Written Opinion dated Jul. 30, 2009 for International Application No. PCT/CA2009/000501 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Zhiguo Meng et al; "24.3: Active-Matrix Organic Light-Emitting Diode Display implemented Using Metal-Induced Unilaterally Crystallized Polycrystalline Silicon Thin-Film Transistors", SID 01Digest, (2001), pp. 380-383.
International Search Report for Application No. PCT/IB2014/059409, Canadian Intellectual Property Office, dated Jun. 12, 2014 (4 pages).
Written Opinion for Application No. PCT/IB2014/059409, Canadian Intellectual Property Office, dated Jun. 12, 2014 (5 pages).
Extended European Search Report for Application No. EP 14181848.4, dated Mar. 5, 2015, (9 pages).

* cited by examiner

PIXEL CIRCUITS FOR MITIGATION OF HYSTERESIS

PRIORITY CLAIM

This application claims priority to U.S. Provisional Application No. 62/430,437, filed Dec. 6, 2016, which is hereby incorporated by reference in its entirety.

FIELD OF THE INVENTION

The present disclosure relates to pixels circuits and signal timing of light emissive visual display technology, and particularly to systems and methods for programming and resetting pixels in active matrix light emitting diode device (AMOLED) and other emissive displays to mitigate hysteresis.

BRIEF SUMMARY

According to a first aspect there is provided a display system comprising: an array of pixel circuits arranged in rows and columns, each pixel circuit including: a driving transistor; a storage capacitor coupled across a gate terminal and a first terminal of the driving transistor; a light emitting device coupled to a second terminal of the driving transistor; and a reset switch transistor coupled between a first reference potential and a node common to a first terminal of the storage capacitor and the gate terminal of the driving transistor; and a controller for driving each pixel circuit during each frame over a plurality of operation cycles for the pixel circuit including a programming cycle for programming the storage capacitor of the pixel circuit, and a reset cycle prior to the programming cycle for resetting the driving transistor of the pixel circuit, the controller resetting the driving transistor of the pixel circuit by activating the reset switch transistor of the pixel circuit during the reset cycle to expose the node of the pixel circuit to the reference potential which causes reverse biasing across the gate and first terminal of the driving transistor.

In some embodiments, the controller activates the reset switch transistor of the pixel circuit during the reset cycle of the pixel circuit with a control signal used for controlling a programming of another pixel circuit during the programming cycle of the another pixel circuit.

In some embodiments, the pixel circuit is of one row other than another row of the another pixel circuit. In some embodiments, the one row and the another row are adjacent rows.

In some embodiments, the controller programs the pixel circuit during the programming cycle of the pixel circuit using a write signal for the one row for controlling a first switch transistor for coupling a data line with the storage capacitor of the pixel circuit and using a read signal for the one row for controlling a second switch transistor for coupling a monitor line with the storage capacitor of the pixel circuit, and the control signal used for controlling the programming of the another pixel circuit is one of a write signal and a read signal for the another row.

In some embodiments, the controller further is for driving each pixel circuit over a plurality of operation cycles including a compensation cycle and a settling cycle after the programming cycle, during the compensation cycle the controller using the read signal to deactivate the second switch transistor to decouple the monitor line from the storage capacitor of the pixel circuit allowing the storage capacitor to discharge through the driving transistor of the pixel circuit during the compensation cycle.

Some embodiments further provide for a third switch transistor shared by at least a first and a second pixel circuit of the one row, in which the second switch transistor is shared by the at least a first and a second pixel circuit, in which the controller programs the at least a first and a second pixel circuit during the programming cycle using the read signal for the one row for controlling the shared second switch transistor for coupling the monitor line with the storage capacitors of the at least a first and a second pixel circuit, and in which the controller further is for driving each pixel circuit over a plurality of operation cycles including an emission cycle after the programming cycle, during the emission cycle the controller using an emission signal line to control the third switch transistor to couple the driving transistors of the at least a first and a second pixel circuit to the first reference potential.

In some embodiments, the controller programs the pixel circuit during the programming cycle of the first circuit using a write signal for the one row for controlling a first switch transistor for coupling a data line with the storage capacitor of the pixel circuit and for controlling a second switch transistor for coupling a monitor line with the storage capacitor of the pixel circuit, in which the control signal used for controlling the programming of the another pixel is a write signal for the another row.

Some embodiments further provide for a third switch transistor shared by at least a first and a second pixel circuit of the one row, in which the second switch transistor is shared by the at least a first and a second pixel circuit, in which the controller further is for driving each pixel circuit over a plurality of operation cycles including an emission cycle after the programming cycle, during the emission cycle the controller using an emission signal line to control the third switch transistor to couple the driving transistors of the at least a first and a second pixel circuit to the first reference potential.

According to another aspect, there is provided a method of driving a display system, the display system including an array of pixel circuits arranged in rows and columns, each pixel circuit including: a driving transistor; a storage capacitor coupled across a gate terminal and a first terminal of the driving transistor; a light emitting device coupled to a second terminal of the driving transistor; and a reset switch transistor coupled between a first reference potential and a node common to a first terminal of the storage capacitor and the gate terminal of the driving transistor; the method comprising: driving each pixel circuit during each frame over a plurality of operation cycles for the pixel circuit including a programming cycle and a reset cycle, comprising: during the programming cycle, programming the storage capacitor of the pixel circuit, and during a reset cycle prior to the programming cycle, resetting the driving transistor of the pixel circuit by activating the reset switch transistor of the pixel circuit during the reset cycle to expose the node of the pixel circuit to the reference potential which causes reverse biasing across the gate and first terminal of the driving transistor.

In some embodiments resetting the driving transistor comprises activating the reset switch transistor of the pixel circuit with a control signal used for controlling a programming of another pixel circuit during the programming cycle of the another pixel circuit.

Some embodiments further provide for programming the pixel circuit during the programming cycle using a write signal for the one row for controlling a first switch transistor for coupling a data line with the storage capacitor of the pixel circuit and using a read signal for the one row for controlling a second switch transistor for coupling a monitor line with the storage capacitor of the pixel circuit, in which the control signal used for controlling the programming of the another pixel circuit is one of a write signal and a read signal for the another row.

In some embodiments, the plurality of operation cycles includes a compensation cycle and a settling cycle, in which driving each pixel circuit further comprises after the programming cycle, during compensation cycle, deactivating the second switch transistor using the read signal to decouple the monitor line from the storage capacitor of the pixel circuit allowing the storage capacitor to discharge through the driving transistor of the pixel circuit during the compensation cycle.

Some embodiments further provide for, programming the pixel circuit during the programming cycle using a write signal for the one row for controlling a first switch transistor for coupling a data line with the storage capacitor of the pixel circuit and for controlling a second switch transistor for coupling a monitor line with the storage capacitor of the pixel circuit, in which the control signal used for controlling the programming of the another pixel is a write signal for the another row.

According to a further aspect there is provided a display system comprising: an array of pixel circuits arranged in rows and columns, each pixel circuit including: a driving transistor; a storage capacitor coupled across a gate terminal and a first terminal of the driving transistor; a light emitting device coupled to a second terminal of the driving transistor; and a switch transistor coupled between a reference voltage and a node common to a first terminal of the storage capacitor and the first terminal of the driving transistor; and a controller for driving each pixel circuit during each frame over a plurality of operation cycles for the pixel circuit including a programming cycle for programming the storage capacitor of the pixel circuit, and a reset cycle prior to the programming cycle for resetting the driving transistor of the pixel circuit, the controller resetting the driving transistor of the pixel circuit by activating the switch transistor of the pixel circuit during the reset cycle to expose the node of the pixel circuit to the reference voltage which is set to a voltage to cause reverse biasing across the gate and first terminal of the driving transistor.

In some embodiments, the controller programs the pixel circuit during the programming cycle of the pixel circuit by deactivating the switch transistor, activating a first switch transistor for coupling a data line with the storage capacitor and the gate terminal of the driving transistor of the pixel circuit and activating a second switch transistor for coupling a controllable reference potential with the node of the pixel circuit.

In some embodiments, the controller further is for driving each pixel circuit over a plurality of operation cycles including a compensation cycle and a settling cycle after the programming cycle, during the compensation cycle the controller deactivating the second switch transistor to decouple the controllable reference potential from the node of the pixel circuit allowing the storage capacitor to discharge through the driving transistor of the pixel circuit during the compensation cycle.

According to yet another aspect there is provided a method of driving a display system, the display system including an array of pixel circuits arranged in rows and columns, each pixel circuit including: a driving transistor; a storage capacitor coupled across a gate terminal and a first terminal of the driving transistor; a light emitting device coupled to a second terminal of the driving transistor; and a switch transistor coupled between a reference voltage and a node common to a first terminal of the storage capacitor and the first terminal of the driving transistor; the method comprising: driving each pixel circuit during each frame over a plurality of operation cycles for the pixel circuit including a programming cycle and a reset cycle, comprising: during the programming cycle, programming the storage capacitor of the pixel circuit, and during a reset cycle prior to the programming cycle, resetting the driving transistor of the pixel circuit by activating the switch transistor of the pixel circuit during the reset cycle to expose the node of the pixel circuit to the reference voltage which is set to a voltage to cause reverse biasing across the gate and first terminal of the driving transistor.

Some embodiments further provide for programming the pixel circuit during the programming cycle by deactivating the switch transistor, activating a first switch transistor for coupling a data line with the storage capacitor and the gate terminal of the driving transistor of the pixel circuit, and activating a second switch transistor for coupling a controllable reference potential with the node of the pixel circuit.

In some embodiments, the plurality of operation cycles includes a compensation cycle and a settling cycle, in which driving each pixel circuit further comprises after the programming cycle, during the compensation cycle, deactivating the second switch transistor to decouple the controllable reference potential from the node of the pixel circuit allowing the storage capacitor to discharge through the driving transistor of the pixel circuit during the compensation cycle.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
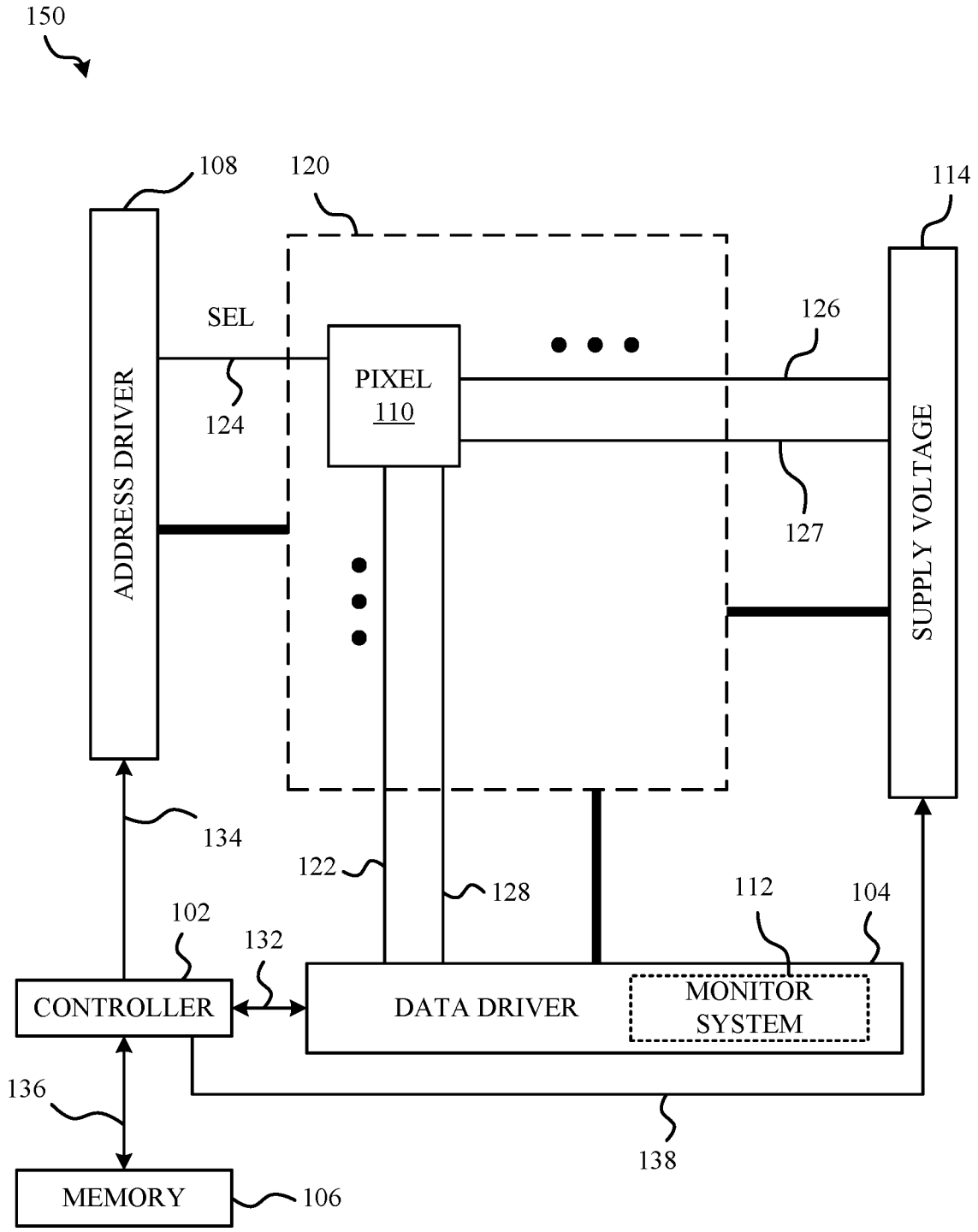
FIG. 1 illustrates an example display system utilizing the methods and comprising the pixels disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from defects, variations, and non-uniformities, from the moment of fabrication, and can suffer further from aging and deterioration over the operational lifetime of the display, which result in the production of images which deviate from those which are intended. Methods of image calibration and compensation are used to correct for those defects in order to produce images which are more accurate, uniform, or otherwise more closely reproduce the image represented by the image data. Some displays suffer from hysteresis effects due to the trapping of carriers in the TFT channel of the driving transistor after being forward biased in saturation mode for a sufficient time. This affects the I-V characteristics of the TFT including its threshold voltage, which are exhibited as hysteresis effects which can affect the accuracy and uniformity of the display.

The display systems, pixels, and methods disclosed below address these issues through control timing and a reset cycle for the pixel circuits as described below.

While the embodiments described herein will be in the context of AMOLED displays it should be understood that the systems and methods described herein are applicable to any other display comprising pixels which might utilize current biasing, including but not limited to light emitting diode displays (LED), electroluminescent displays (ELD), organic light emitting diode displays (OLED), plasma display panels (PSP), among other displays.

It should be understood that the embodiments described herein pertain to systems and methods of calibration and compensation and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods and pixel circuits described further below. The display system 150 includes a display panel 120, an address driver 108, a data driver 104, a controller 102, and a memory storage 106.

The display panel 120 includes an array of pixels 110 (only one explicitly shown) arranged in rows and columns. Each of the pixels 110 is individually programmable to emit light with individually programmable luminance values. The controller 102 receives digital data indicative of information to be displayed on the display panel 120. The controller 102 sends signals 132 to the data driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen can display images and streams of video information from data received by the controller 102. The supply voltage 114 provides a constant power voltage or can serve as an adjustable voltage supply that is controlled by signals from the controller 102. The display system 150 can also incorporate features from a current source or sink (not shown) to provide biasing currents to the pixels 110 in the display panel 120 to thereby decrease programming time for the pixels 110.

For illustrative purposes, only one pixel 110 is explicitly shown in the display system 150 in FIG. 1. It is understood that the display system 150 is implemented with a display screen that includes an array of a plurality of pixels, such as the pixel 110, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

The pixel 110 is operated by a driving circuit of the pixel circuit that generally includes a driving transistor and a light emitting device. Hereinafter the pixel 110 may be referred to also as a "pixel circuit". The light emitting device can optionally be an organic light emitting diode, but implementations of the present disclosure apply to pixel circuits having other electroluminescence devices, including current-driven light emitting devices and those listed above. The driving transistor in the pixel 110 can optionally be an n-type or p-type amorphous silicon thin-film transistor, but implementations of the present disclosure are not limited to pixel circuits having a particular polarity of transistor or only to pixel circuits having thin-film transistors. The pixel circuit 110 can also include a storage capacitor for storing programming information and allowing the pixel circuit 110 to drive the light emitting device after being addressed. Thus, the display panel 120 can be an active matrix display array.

As illustrated in FIG. 1, the pixel 110 illustrated as the top-left pixel in the display panel 120 is coupled to a select line 124 (also referred to as a write signal line), a supply line 126, a data line 122, and a monitor line 128. A read line and an emission control line may also be included for respectively controlling connections to the monitor line and providing additional control of emission from the pixel. In one implementation, the supply voltage 114 can also provide a second supply line to the pixel 110. For example, each pixel can be coupled to a first supply line 126 charged with ELVDD and a second supply line 127 coupled with ELVSS, and the pixel circuits 110 can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 110 of the display panel 120, the select line 124 is provided by the address driver 108, and can be utilized to enable, for example, a programming operation of the pixel 110 by activating a switch or transistor to allow the data line 122 to program the pixel 110. The data line 122 conveys programming information from the data driver 104 to the pixel 110. For example, the data line 122 can be utilized to apply a programming voltage $V_{DATA}$ or a programming current to the pixel 110 in order to program the pixel 110 to emit a desired amount of luminance. The programming voltage (or programming current) supplied by the data driver 104 via the data line 122 is a voltage (or current) appropriate to cause the pixel 110 to emit light with a desired amount of luminance according to the digital data received by the controller 102. The programming voltage (or programming current) can be applied to the pixel 110 during a programming operation of the pixel 110 so as to charge a storage device within the pixel 110, such as a storage capacitor, thereby enabling the pixel 110 to emit light with the desired amount of luminance during an emission operation following the programming operation. For example, the storage device in the pixel 110 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 110, the driving current that is conveyed through the light emitting device by the driving transistor during the emission operation of the pixel 110 is a current that is supplied by the first supply line 126 and is drained to a second supply line 127. The first supply line 126 and the second supply line 127 are coupled to the voltage supply 114. The first supply line 126 can provide a positive supply voltage (e.g., the voltage commonly referred to in circuit design as "ELVDD") and the second supply line 127 can provide a negative supply voltage (e.g., the voltage commonly referred to in circuit design as "ELVSS"). In some embodiments the positive supply voltage "ELVDD" is a controllable positive supply which may be set to provide different voltage levels including for example, reference voltages, and the standard ELVDD rail. Implementations of the present disclosure can be realized where one or the other of the supply lines (e.g., the supply line 127) is fixed at a ground voltage or at another reference voltage.

The display system 150 also includes a monitoring system 112. With reference again to the pixel 110 of the display panel 120, the monitor line 128 connects the pixel 110 to the monitoring system 112. The monitoring system 12 can be integrated with the data driver 104, or can be a separate stand-alone system. In particular, the monitoring system 112 can optionally be implemented by monitoring the current and/or voltage of the data line 122 during a monitoring operation of the pixel 110, and the monitor line 128 can be entirely omitted. The monitor line 128 allows the monitoring system 112 to measure a current or voltage associated with the pixel 110 and thereby extract information indicative of a degradation or aging of the pixel 110 or indicative of a temperature of the pixel 110. In some embodiments, display panel 120 includes temperature sensing circuitry devoted to sensing temperature implemented in the pixels 110, while in other embodiments, the pixels 110 comprise circuitry which participates in both sensing temperature and driving the pixels. For example, the monitoring system 112 can extract, via the monitor line 128, a current flowing through the driving transistor within the pixel 110 and thereby determine, based on the measured current and based on the voltages applied to the driving transistor during the measurement, a threshold voltage of the driving transistor or a shift thereof. In some implementations the monitor line 128 is used during a programming cycle to provide a second voltage $V_{MON}$ used in addition to the programming voltage $V_{DATA}$ to program the pixel.

The controller and 102 and memory store 106 together or in combination with a compensation block (not shown) use compensation data or correction data, in order to address and correct for the various defects, variations, and non-uniformities, existing at the time of fabrication, and optionally, defects suffered further from aging and deterioration after usage. In some embodiments, the correction data includes data for correcting the luminance of the pixels obtained through measurement and processing using an external optical feedback system. Some embodiments employ the monitoring system 112 to characterize the behavior of the pixels and to continue to monitor aging and deterioration as the display ages and to update the correction data to compensate for said aging and deterioration over time.

Figure 2A:
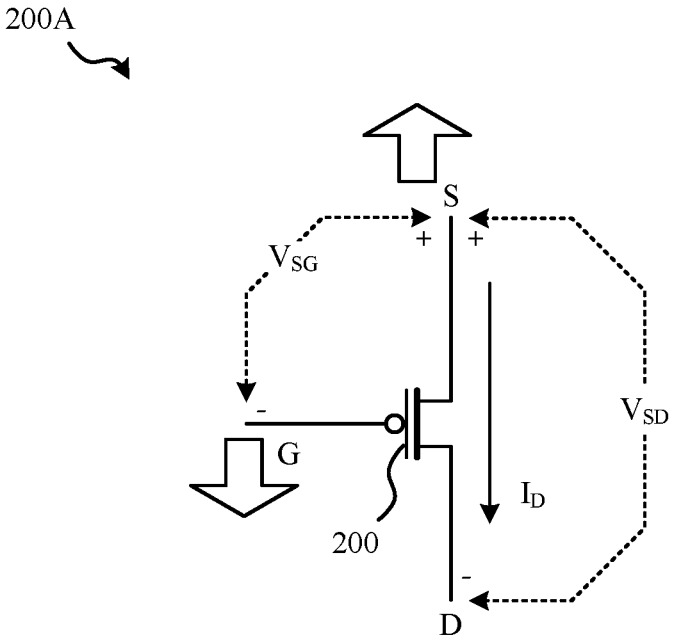
FIG. 2A is a circuit diagram of a thin film transistor (TFT) forward biased.
Figure 2B:
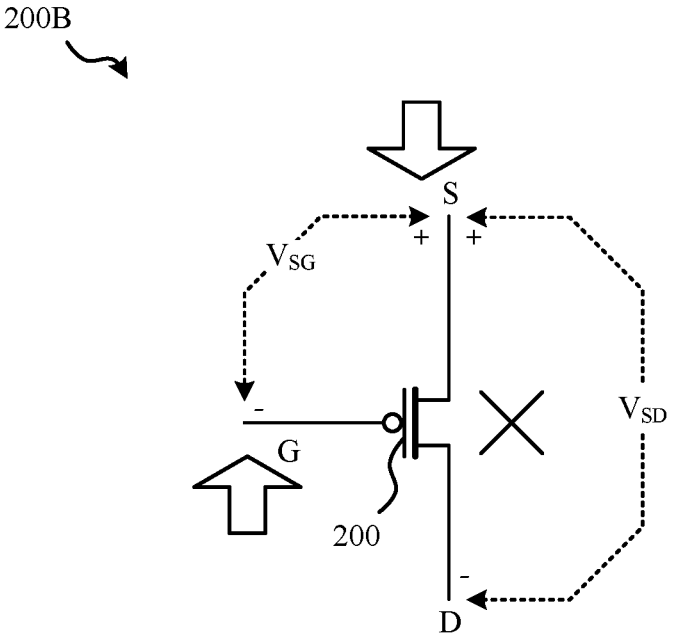
FIG. 2B is a circuit diagram of a thin film transistor (TFT) reverse biased.

FIGS. 2A and 2B illustrate a transistor 200, in this case, a p-type thin film transistor (TFT), having a gate terminal G, a source terminal S, and a drain terminal D, which exhibits a hysteresis effect in response to biasing in the saturation region.

In FIG. 2A, the transistor 200 is depicted while being forward biased 200A in the saturation region, such that the gate voltage ($V_G$) is less than the voltage at the source ($V_S$) so that the source-gate voltage $V_{SG}$ is greater than zero ($V_{SG}>0$) and such that the source-drain voltage $V_{SD}$ is greater than the difference between the source-gate voltage $V_{SG}$ and the threshold voltage ($V_{TH}$) of the transistor 200 ($V_{SD}>V_{SG}-V_{TH}$). As shown, when the transistor 200 is driven as illustrated in FIG. 2A, a driving current ID flows through the transistor 200.

When the transistor 200 is biased in this manner for a sufficient duration, which varies depending upon the transistor and various conditions of operation (in some cases, for example, a duration of 1 minute or greater is sufficient), short-term trapping of carriers in the TFT channel is caused which gives rise to temporary shifts in the threshold voltage of the transistor 200. Thereafter, while carriers remain so trapped, the transistor 200 will suffer from and exhibit hysteresis effects in its I-V response as different source-gate voltages $V_{SG}$ are applied.

As depicted in FIG. 2B, to mitigate the effect of hysteresis on the I-V response of the transistor 200, the transistor 200 can be periodically driven 200B during a reset cycle with a negative driver voltage, such that the gate voltage ($V_G$) is greater than the voltage at the source ($V_S$) and thus the source-gate voltage is less than zero ($V_{SG}<0$). This triggers the release of carriers and hence a reversal of the short-term trapping of carriers, resetting the transistor 200 and its threshold voltage ($V_{TH}$), and mitigating hysteresis in the I-V response exhibited by the transistor 200. As shown in FIG. 2B, when transistor 200 is driven with a negative driver voltage 200B, no current flows the source S to the drain D. Some embodiments which follow utilize a reset cycle prior to each programming cycle to improve performance of the transistor 200.

Figure 3:
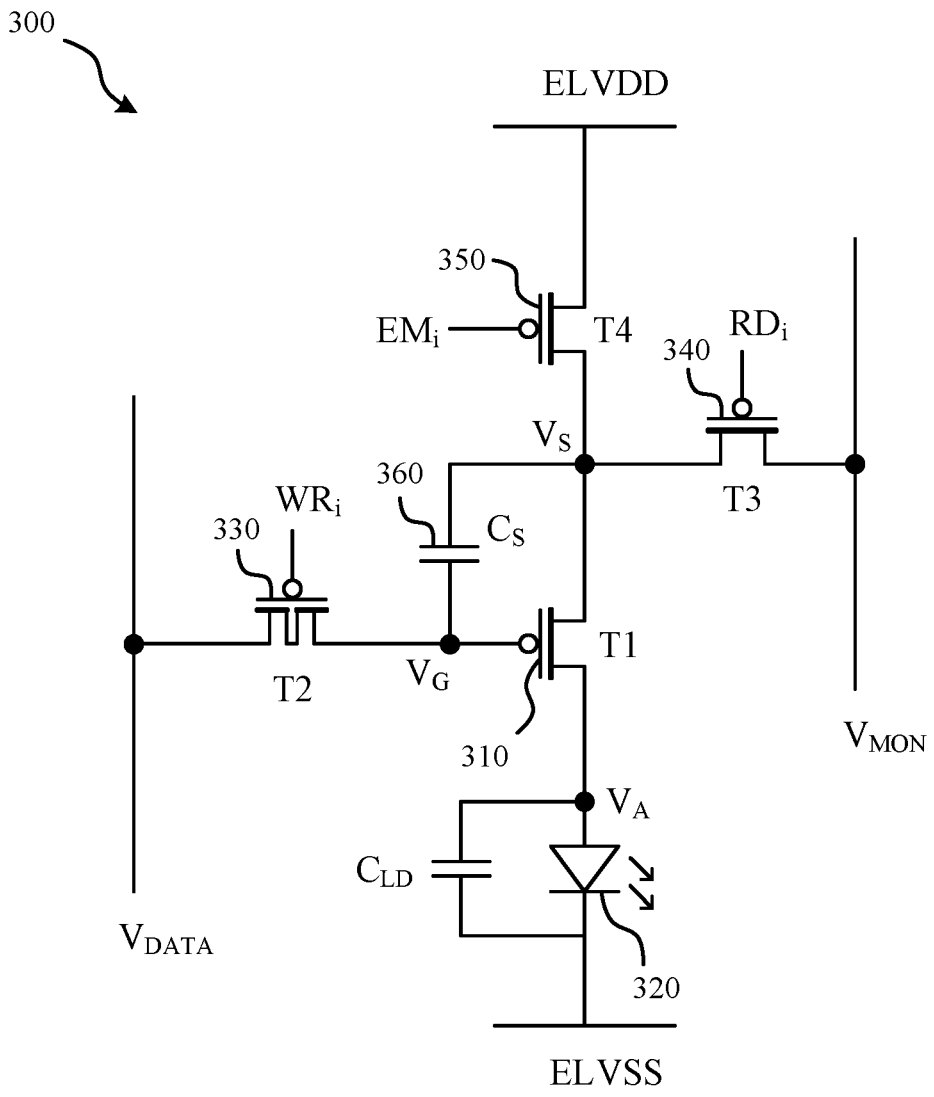
FIG. 3 circuit diagram of a four transistor single capacitor (4T1C) pixel circuit according to an embodiment with in-pixel compensation.

With reference to FIG. 3, the structure of a four transistor single capacitor (4T1C) pixel circuit 300 according to an embodiment utilizing in-pixel compensation will now be described. The 4T1C pixel circuit 300 corresponds, for example, to a single pixel 110 in the ith row of the display system 150 depicted in FIG. 1. The 4T1C pixel circuit 300 depicted in FIG. 3 is based on NMOS transistors. It should be understood that variations of this pixel and its functioning are contemplated and include different types of transistors (PMOS, NMOS, or CMOS) and different semiconductor materials (e.g. LTPS, Metal Oxide, etc.).

The 4T1C pixel circuit 300 includes a driving transistor 310 (T1), a light emitting device 320, a first switch transistor 330 (T2), a second switch transistor 340 (T3), a third switch transistor 350 (T4), and a storage capacitor 360 (Cs). Each of the driving transistor 310, the first switch transistor 330, the second switch transistor 340, and the third switch transistor 350 having first, second, and gate terminals, and each of the light emitting device 320 and the storage capacitor 360 having first and second terminals.

The gate terminal of the driving transistor 310 is coupled to a first terminal of the storage capacitor 360, while the first terminal of the driving transistor 310 is coupled to the second terminal of the storage capacitor 360, and the second terminal of the driving transistor 310 is coupled to the first terminal of the light emitting device 320. The gate terminal of the first switch transistor 330 is coupled to a write signal line ($WR_i$) of the ith row, while the first terminal of the first switch transistor 330 is coupled to a data line ($V_{DATA}$), and the second terminal of the first switch transistor 330 is coupled to the gate terminal of the driving transistor 310. A node common to the gate terminal of the driving transistor 310 and the storage capacitor 360 as well as the first switch transistor 330 is labelled by its voltage $V_G$ in the figure. The gate terminal of the second switch transistor 340 is coupled to a read line ($RD_i$) of the ith row, while the first terminal of the second switch transistor 340 is coupled to a monitor line ($V_{MON}$), and the second terminal of the second switch transistor 340 is coupled to the second terminal of the storage capacitor 360. The gate terminal of the third switch transistor 350 is coupled to an emission signal line ($EM_i$) of the ith row, while the first terminal of the third switch transistor 350 is coupled to a first reference potential ELVDD, and the second terminal of the third switch transistor 350 is coupled to the second terminal of the storage capacitor 360. A node common to the second terminal of the storage capacitor 360, the driving transistor 310, the second switch transistor 340, and the third switch transistor 350 is labelled by its voltage $V_S$ in the figure. The second terminal of the light emitting device 320 is coupled to a second reference potential ELVSS. A capacitance of the light emitting device 320 is depicted in FIG. 3 as $C_{LD}$. In some embodiments, the light emitting device 320 is an OLED.

The 4T1C pixel circuit 300 of FIG. 3, as will become apparent from the description of its functioning below, is capable of achieving a good level of in-pixel compensation which is useful for mitigating the hysteresis effects in the driving transistor 310.

Figure 4:
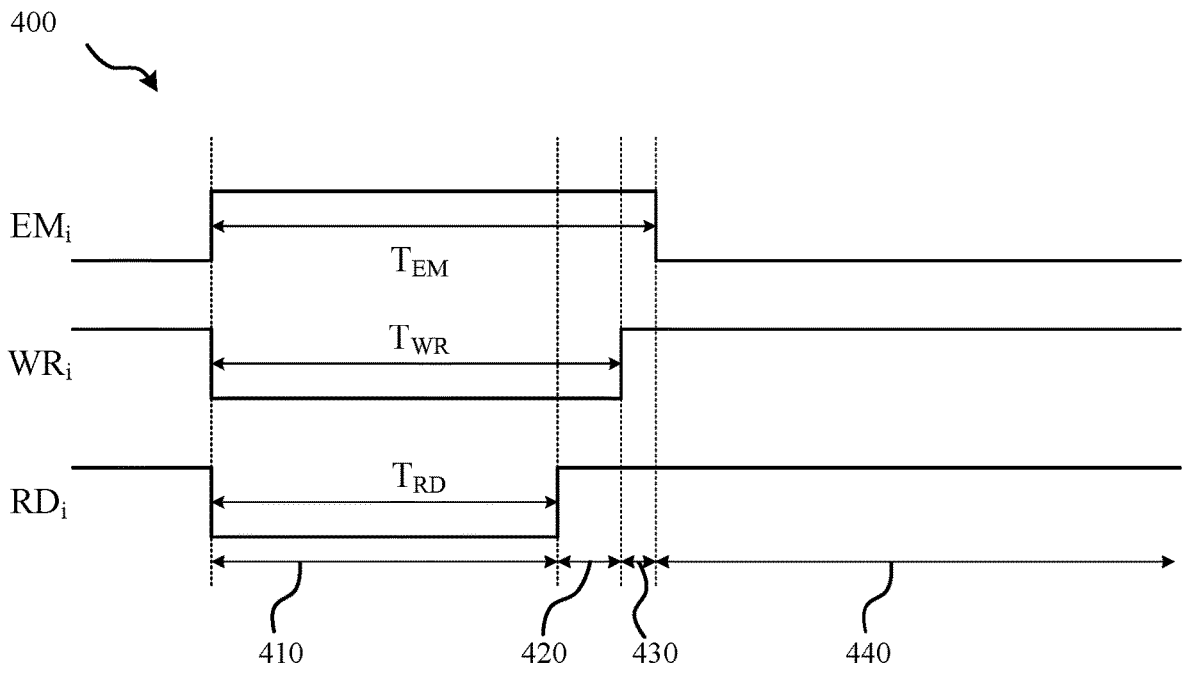
FIG. 4 is a timing diagram illustrating programming and driving of a 4T1C pixel circuit.

With reference also to FIG. 4, an example of a display timing 400 for the 4T1C pixel circuit 300 depicted in FIG. 3 will now be described. The complete display timing 400 occurs typically once per frame and includes a programming cycle 410, a calibration cycle 420, a settling cycle 430, and an emission cycle 440. During the programming cycle 410 over a period $T_{RD}$, the read signal ($RD_i$) and write signal ($WR_i$) are held low while the emission ($EM_i$) signal is held high. The emission signal ($EM_i$) is held high throughout the programming, calibration, and settling cycles 410 420 430 to ensure the third switch transistor 350 remains OFF during those cycles ($T_{EM}$).

During the programming cycle 410 the first switch transistor 330 and the second switch transistor 340 are both ON. The voltage of the storage capacitor 360 and therefore the voltage $V_{SG}$ of the driving transistor 310 is charged to a value of $V_{MON}-V_{DATA}$ where $V_{MON}$ is a voltage of the monitor line and $V_{DATA}$ is a voltage of the data line. These voltages are set in accordance with a desired programming voltage for causing the pixel 300 to emit light at a desired luminance according to image data.

At the beginning of the calibration cycle 420, the read signal ($RD_i$) goes high to turn OFF the second switch transistor 340 to discharge some of the voltage (charge) of the storage capacitor 360 through the driving transistor 310. The amount discharged is a function of the characteristics of the driving transistor 310. For example, if the driving transistor 310 is "strong", the discharge occurs relatively quickly and relatively more charge is discharged from the storage capacitor 360 through the driving transistor 310 during the fixed duration of the calibration cycle 420. On the other hand, if the driving transistor 310 is "weak", the discharge occurs relatively slowly and relatively less charge is discharged from the storage capacitor 360 through the driving transistor 310 during the calibration cycle 420. As a result, the voltage (charge) stored in the storage capacitor 360 ($V_P$) is reduced comparatively more for relatively strong driving transistors versus comparatively less for relatively weak driving transistors, thereby providing some compensation for non-uniformity and variations in the driving transistors across the display whether due to variations in fabrication, variations in degradation over time, or variations due to hysteresis in the temporary threshold voltage of the driving transistor 310.

After the calibration cycle 420, a settling cycle 430 is performed prior to the emission. During the settling cycle 430 the second and third switch transistors 340, 350 remain OFF, while the write signal ($WR_i$) goes high to also turn OFF the first switch transistor 330. After completion of the duration of the settling cycle 430 at the start of the emission cycle 440, the emission signal ($EM_i$) goes low turning ON the third switch transistor 350 allowing current to flow through the light emitting device 320 according to the calibrated stored voltage on the storage capacitor 360.

Although the pixel 300 circuit is capable of achieving in-pixel compensation including that related to hysteresis to a good level for high and medium grayscales, low grayscale compensation may be insufficient to meet high-end uniformity specifications.

Figure 5:
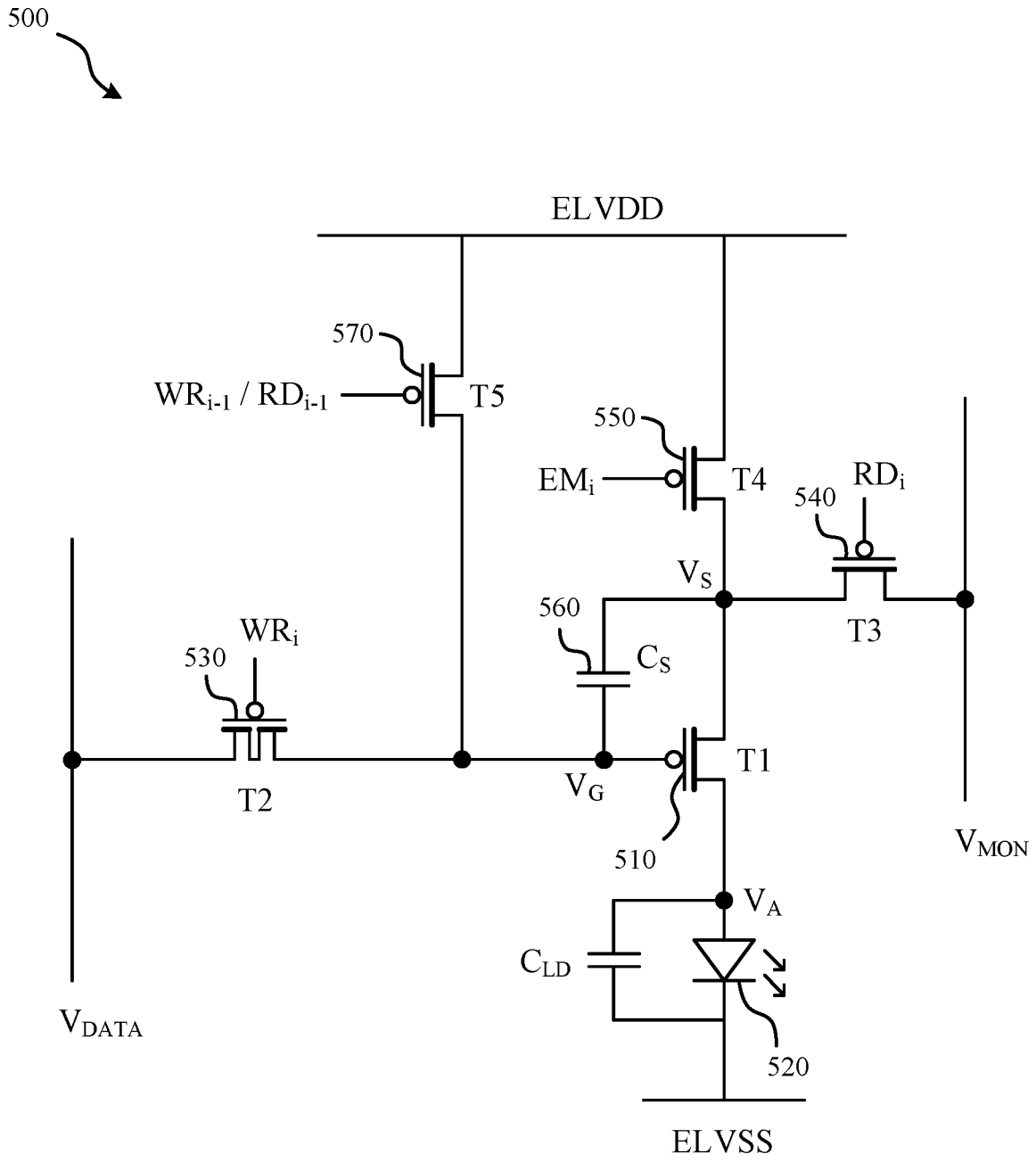
FIG. 5 is a circuit diagram of a five transistor single capacitor (5T1C) pixel circuit according to an embodiment.

With reference to FIG. 5, the structure of a five transistor, single capacitor (5T1C) pixel circuit 500 according to an embodiment will now be described. The 5T1C pixel circuit 500 corresponds, for example, to a single pixel 110 in the ith row of the display system 150 depicted in FIG. 1. The 5T1C pixel circuit 500 depicted in FIG. 5 is based on NMOS transistors. It should be understood that variations of this pixel and its functioning are contemplated and include different types of transistors (PMOS, NMOS, or CMOS) and different semiconductor materials (e.g. LTPS, Metal Oxide, etc.).

The 5T1C pixel circuit 500 includes a driving transistor 510 (T1), a light emitting device 520, a first switch transistor 530 (T2), a second switch transistor 540 (T3), a third switch transistor 550 (T4), and a storage capacitor 560 (Cs) in substantially the same configuration as that of the 4T1C pixel circuit 300 of FIG. 3. The 5T1C pixel circuit 500 also includes a reset switch transistor 570 (T5) coupled between ELVDD and a node between the first switch transistor 530 and the storage capacitor 560.

The gate terminal of the driving transistor 510 is coupled to a first terminal of the storage capacitor 560, while the first terminal of the driving transistor 510 is coupled to the second terminal of the storage capacitor 560, and the second terminal of the driving transistor 510 is coupled to the first terminal of the light emitting device 520. The gate terminal of the first switch transistor 530 is coupled to a write signal line ($WR_i$) of the ith row, while the first terminal of the first switch transistor 530 is coupled to a data line ($V_{DATA}$), and the second terminal of the first switch transistor 530 is coupled to the gate terminal of the driving transistor 510. A node common to the gate terminal of the driving transistor 510 and the storage capacitor 560 as well as the first switch transistor 530 is labelled by its voltage $V_G$ in the figure. The gate terminal of the second switch transistor 540 is coupled to a read line ($RD_i$) of the ith row, while the first terminal of the second switch transistor 540 is coupled to a monitor line ($V_{MON}$), and the second terminal of the second switch transistor 540 is coupled to the second terminal of the storage capacitor 560. The gate terminal of the third switch transistor 550 is coupled to an emission signal line ($EM_i$) of the ith row, while the first terminal of the third switch transistor 550 is coupled to a first reference potential ELVDD, and the second terminal of the third switch transistor 550 is coupled to the second terminal of the storage capacitor 560. A node common to the second terminal of the storage capacitor 560, the driving transistor 510, the second switch transistor 540, and the third switch transistor 550 is labelled by its voltage $V_S$ in the figure. The second terminal of the light emitting device 520 is coupled to a second reference potential ELVSS. A capacitance of the light emitting device 520 is depicted in FIG. 5 as $C_{LD}$. In some embodiments, the light emitting device 520 is an OLED.

As mentioned above, the 5T1C pixel circuit 500 includes a reset switch transistor 570 coupled between the gate terminal of the drive transistor 510 and the first reference potential ELVDD. The first terminal of the reset switch transistor 570 is coupled to the first reference potential ELVDD and the second terminal of the reset switch transistor 570 is coupled to the node $V_G$ common to the first switch transistor 530, the storage capacitor 560, and the driving transistor 510. The gate terminal of the reset switch transistor 570 is coupled to a read or write signal line of a different row, for example, the read line $RD_{i-1}$ of the (i−1)th row or the write signal line $WR_{i-1}$ of the (i−1)th row. The 5T1C pixel circuit 500 is capable of achieving both a good level of in-pixel compensation if so driven (which is useful for mitigating the hysteresis effects in the driving transistor 510) as well as being capable of releasing charges trapped in the channel of the driving transistor 510 through the reset cycle described further below.

Figure 6:
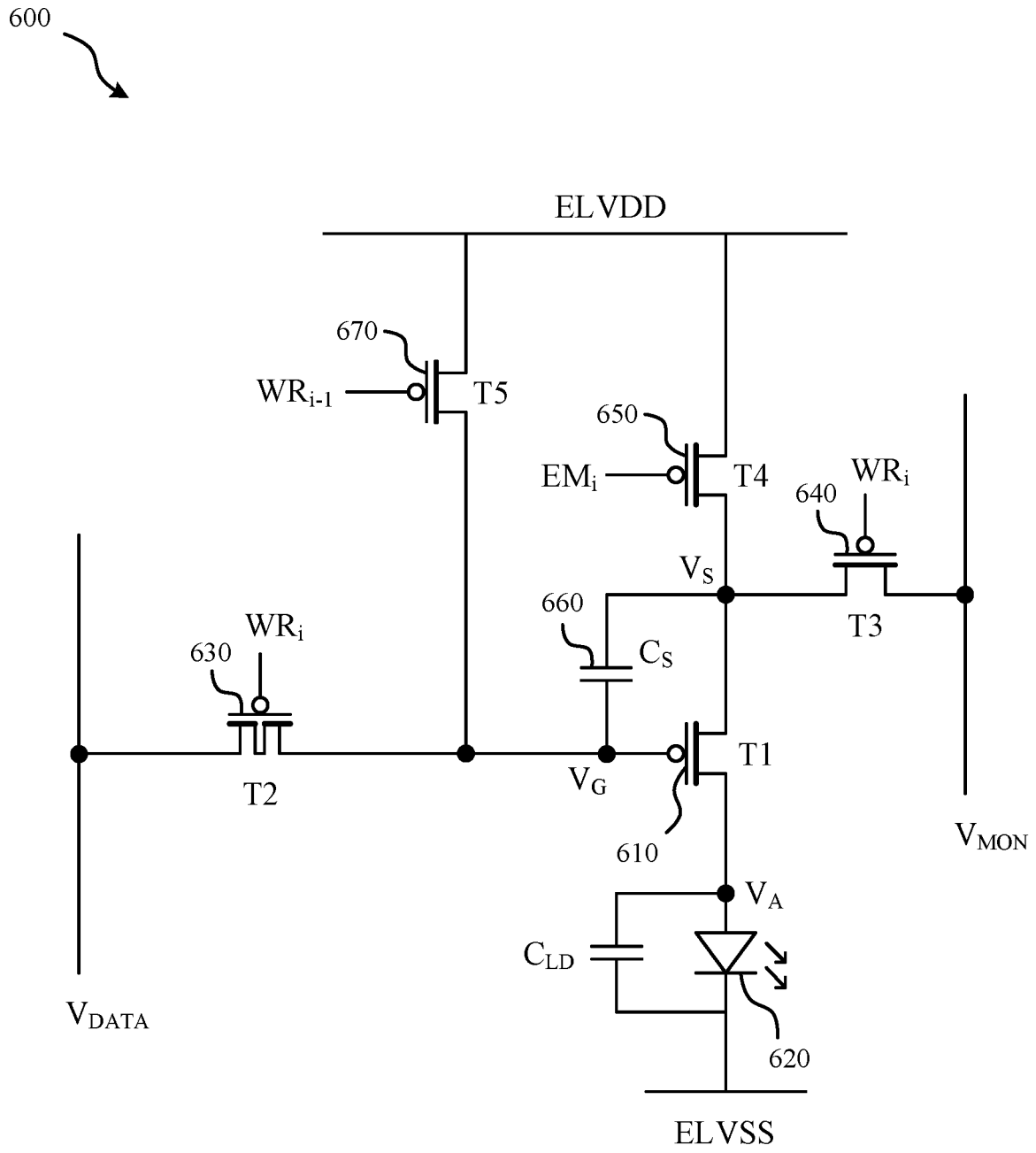
FIG. 6 is a circuit diagram of a modified 5T1C pixel circuit according to a further embodiment.

With reference to FIG. 6, the structure of a modified implementation of a five transistor, single capacitor (5T1C) pixel circuit 600 according to an embodiment will now be described. The modified 5T1C pixel circuit 600 corresponds, for example, to a single pixel 110 in the ith row of the display system 150 depicted in FIG. 1. The modified 5T1C pixel circuit 600 depicted in FIG. 6 is based on NMOS transistors. It should be understood that variations of this pixel and its functioning are contemplated and include different types of transistors (PMOS, NMOS, or CMOS) and different semiconductor materials (e.g. LTPS, Metal Oxide, etc.).

The modified 5T1C pixel circuit 600 includes a driving transistor 610 (T1), a light emitting device 620, a first switch transistor 630 (T2), a second switch transistor 640 (T3), a third switch transistor 650 (T4), a storage capacitor 660 (Cs), and a reset switch transistor 670 (T5) in substantially the same configuration as that of the 5T1C pixel circuit 500 of FIG. 5. The modified 5T1C pixel circuit 600 differs from the pixel circuit 500 only in that the gate terminal of the second switch transistor 640 is coupled to the write signal line ($WR_i$) of the ith row (to which the gate terminal of the first switch transistor 630 is also coupled), and the gate terminal of the reset switch transistor 670 is coupled to a write signal line of a different row, namely, the write signal line $WR_{i-1}$ of the (i−1)th row. This simplifies row (gate) control signals required per row of pixels of the display system 150.

The modified 5T1C pixel circuit 600, in a similar manner as the 5T1C 500 pixel circuit is capable of releasing charges trapped in the channel of the driving transistor 510 through the reset cycle described below.

Figure 7:
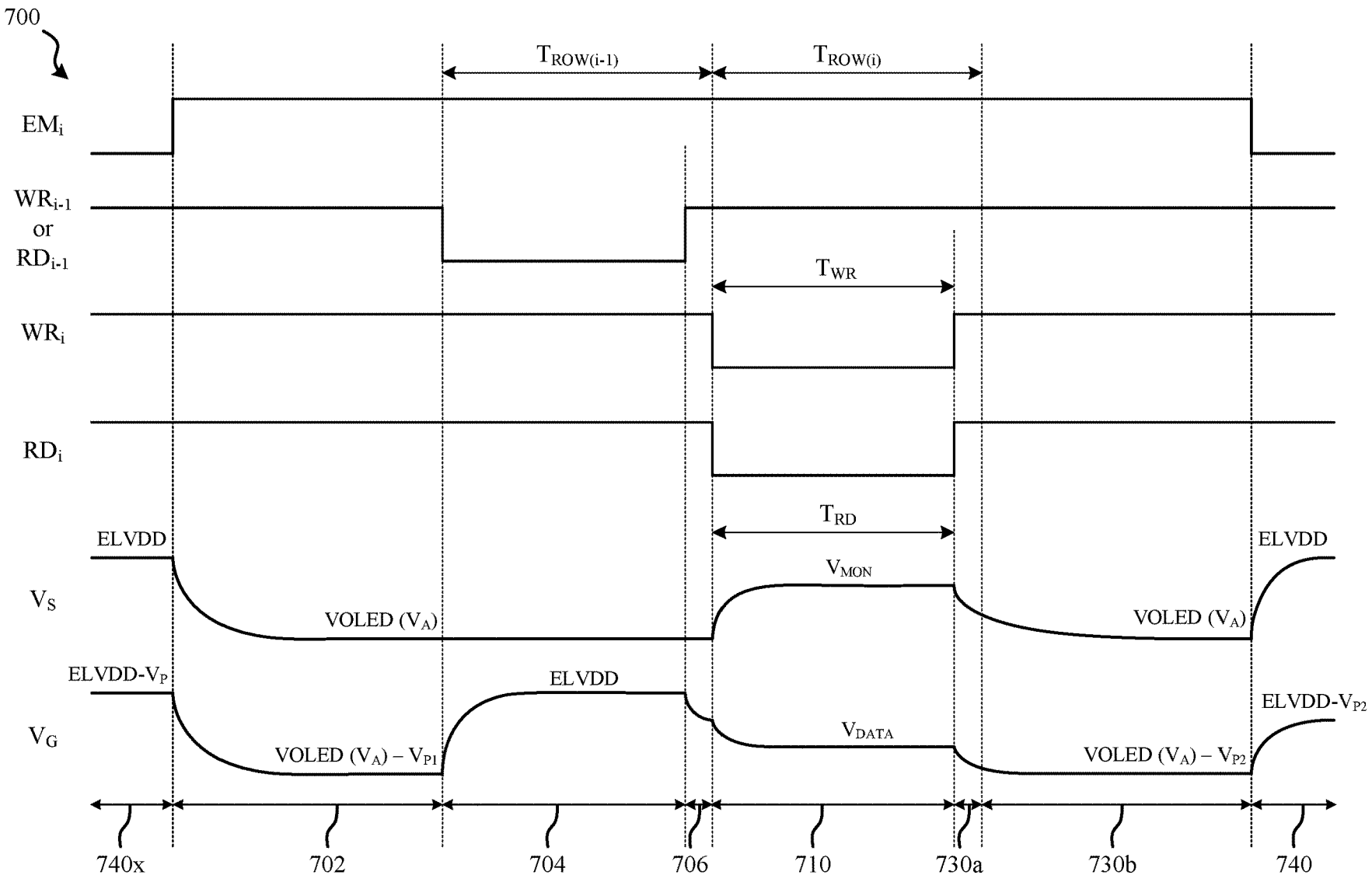
FIG. 7 a timing diagram illustrating programming and driving of a 5T1C pixel circuits of FIGS. 5 and 6.

With reference also to FIG. 7, an example of a display timing 700 for 5T1C pixel circuits 500 and 600 of the ith row depicted in FIGS. 5-6 will now be described. The complete display timing 700 occurs typically once per frame and includes a post-emission settling cycle 702 (which occurs after a previous emission cycle 740*x* of a previous frame), a reset cycle 704, a first settling cycle 706, a programming cycle 710, first and second pre-emission settling cycles 730*a*, 730*b*, and an emission cycle 740.

At the end of the previous emission cycle 740*x* and the beginning of the post-emission settling cycle 702, the emission signal is ($EM_i$) is switched from low to high in order to turn OFF the third switch transistor 550, 650. During non-emission cycles 702, 704, 706, 710, 730*a*, 730*b* the emission ($EM_i$) signal is held high to ensure the third switch transistor 550 or 650 remains OFF during those cycles.

During the post-emission settling cycle 702 each of the transistors of the pixel circuit 500 600 is OFF allowing the voltage $V_S$ to settle to $V_{OLED}$ (the turn on voltage of the light emitting device 520 620), while the voltage $V_G$ to settle to the voltage of the light emitting device minus a voltage on the storage capacitor 560 660 related to a pixel programming of the pixel during the previous frame ($V_{OLED}-V_{P1}$).

After a duration of the post-emission settling cycle 702, a sufficient settling time for $V_S$ to settle to a low voltage, the write or read signal controlling the reset switch transistor 570 670, namely read signal $RD_{i-1}$ for the (i−1)th row, or write signal $WR_{i-1}$ for the (i−1)th row, switches from high to low, turning the reset switch transistor 570 670 ON, which charges node $V_G$ up to ELVDD during the reset cycle 704. Since $V_S$ has been discharged to a low voltage of $V_{OLED}$ which is much less than ELVDD, during reset cycle 704 $V_{SG}$ goes less than zero, the driving transistor 510 610 becomes negatively biased which triggers the release of carriers and hence reversal of the short-term trapping of carriers, resetting the driving transistor 510 610 and its threshold voltage ($V_{TH}$), and mitigating hysteresis in the I-V response exhibited by the driving transistor 510 610 when it is programmed in the following programming cycle 710. The negative biasing utilizing the ELVDD rail is programming independent and provides a high magnitude of reverse biasing for effective release of carriers and hence reduction of hysteresis effects.

After the reset cycle 704, the read signal $RD_{i-1}$ for the (i−1)th row, or write signal $WR_{i-1}$ for the (i−1)th row, switches from low to high, turning the reset switch transistor 570 670 OFF. For a relatively short first settling cycle 706, each of the transistors of the pixel circuit 500 600 are OFF. Following the first settling cycle 706, during the programming cycle 710, both the first switch transistor 530 630 and the second switch transistor 540 640 are turned ON.

For embodiments which include distinct read RD and write WR control signals, such as for the 5T1C pixel circuit 500, the read signal $RD_i$ for the ith row, and the write signal $WR_i$ for the ith row both switch from high to low, turning both the first switch transistor 530 and the second switch transistor 540 ON. For embodiments with only a write signal WR such as for the 5T1C pixel circuit 600, the write signal $WR_i$ for the ith row switches from high to low, turning both the first switch transistor 630 and the second switch transistor 640 ON.

This exposes the first terminal of the storage capacitor 560 660 and the node $V_G$ to $V_{DATA}$ on the data line, and exposes the second terminal of the storage capacitor 560 660 and the node $V_S$ to the voltage $V_{MON}$ on the monitor line.

Over the duration that the first switch transistor 530 is ON ($T_{WR}$), $V_G$ is charged to $V_{DATA}$, and over the duration that the second switch transistor 540 is ON ($T_{RD}$), $V_S$ is charged to $V_{MON}$. In embodiments with only write signals $WR_i$, both the first and second switch transistors 630 640 are ON during $T_{WR}$, during which time $V_G$ is charged to $V_{DATA}$ and $V_S$ is charged to $V_{MON}$.

In some embodiments, the first switch transistor 530 630 and the second switch transistor 540 640 are turned OFF at the same time at the end of the programming cycle 710. In embodiments with separate $WR_i$ and $RD_i$ signals such as the 5TC1 pixel circuit 500, the timing of $T_{WR}$ and $T_{RD}$ may be different, and such that $T_{RD}<T_{WR}<T_{RWOW(i)}$ (where $T_{ROW(i)}$ is the total duration of the programming cycle 710) so as to provide the programming and compensation cycles and the in-pixel compensation described in association with the embodiment depicted in FIG. 3 and FIG. 4.

Once both of the first switch transistor 530 630 and the second switch transistor 540 640 are turned OFF, after the end of the programming cycle 710, is a first pre-emission settling cycles 730*a*, followed by a second pre-emission settling cycle 730*b* during which each transistor of the 5T1C pixel circuit 500 600 are OFF, allowing the voltage $V_S$ to settle at $V_{OLED}$, and allowing the voltage at $V_G$ to settle at $V_{OLED}-V_{P2}$, where $V_{P2}$ is related to the programming voltage ($V_{MON}-V_{DATA}$) and any shift caused by the threshold voltage and any in-pixel compensation. The reset cycle should reduce any hysteresis effects on that threshold voltage and any in-pixel compensation should also reduce the effects of other variations in threshold voltage (such as variations in fabrication) so that $V_{P2}$ more closely matches the desired programming.

Finally, at the beginning of the emission cycle 740, the emission ($EM_i$) signal is switched from high to low to turn ON the third switch transistor 550 or 650.

The same token used for programming a pixel in one row (i−1) over either the $WR_{i-1}$ or $RD_{i-1}$ signal lines (of duration $T_{WR}$ or $T_{RD}$), is re-used to control the reset switch transistor 570, 670 of a pixel in another row (i). The timing generally for programming and settling row i−1 ($T_{ROW(i-1)}$), occurs just prior to but for the same duration as that of the programming and settling of row i ($T_{ROW(i)}$).

Figure 8:
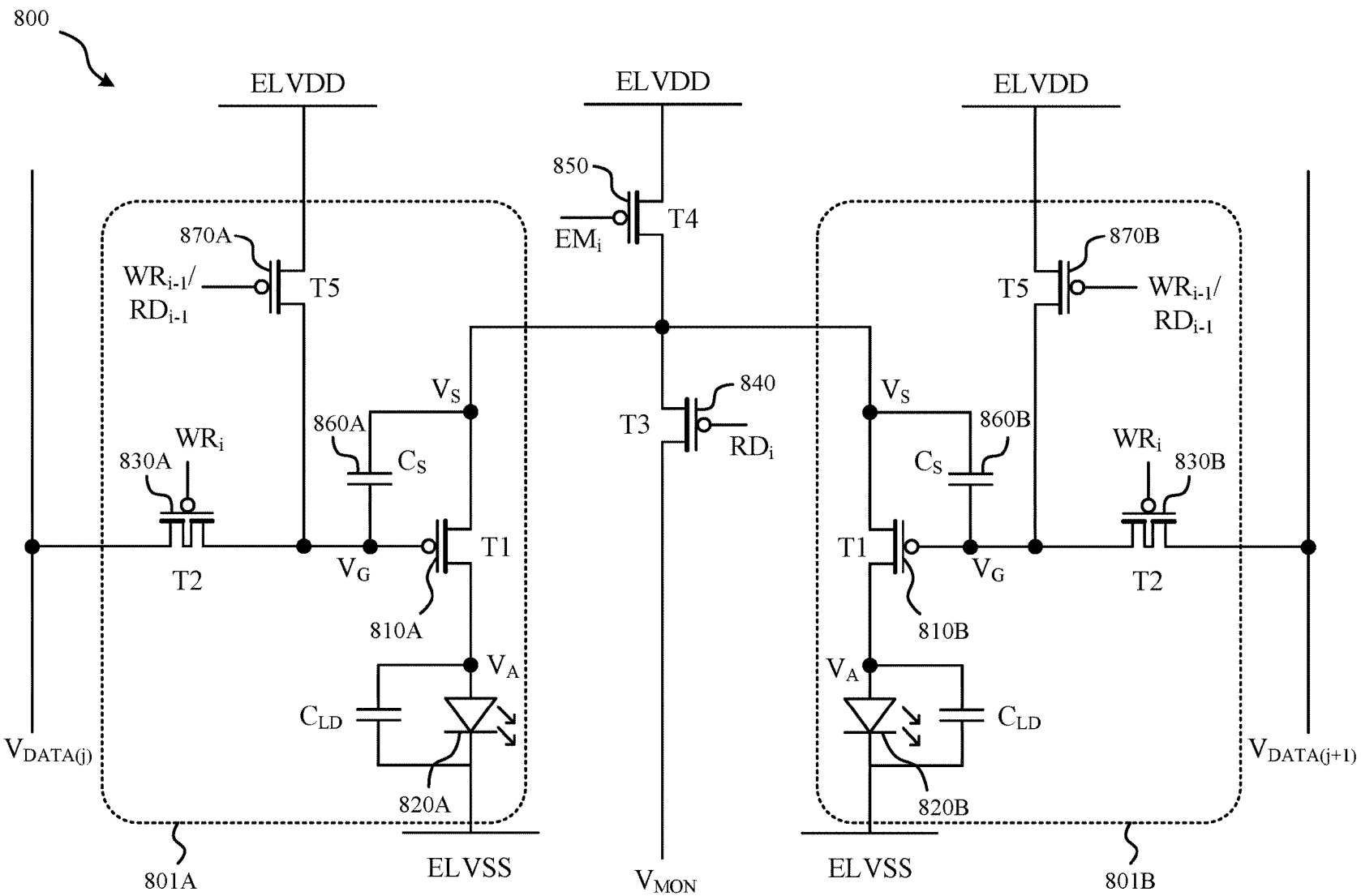
FIG. 8 is a circuit diagram illustrating a TFT sharing implementation of the 5T1C pixel circuit of FIG. 5.
Figure 9:
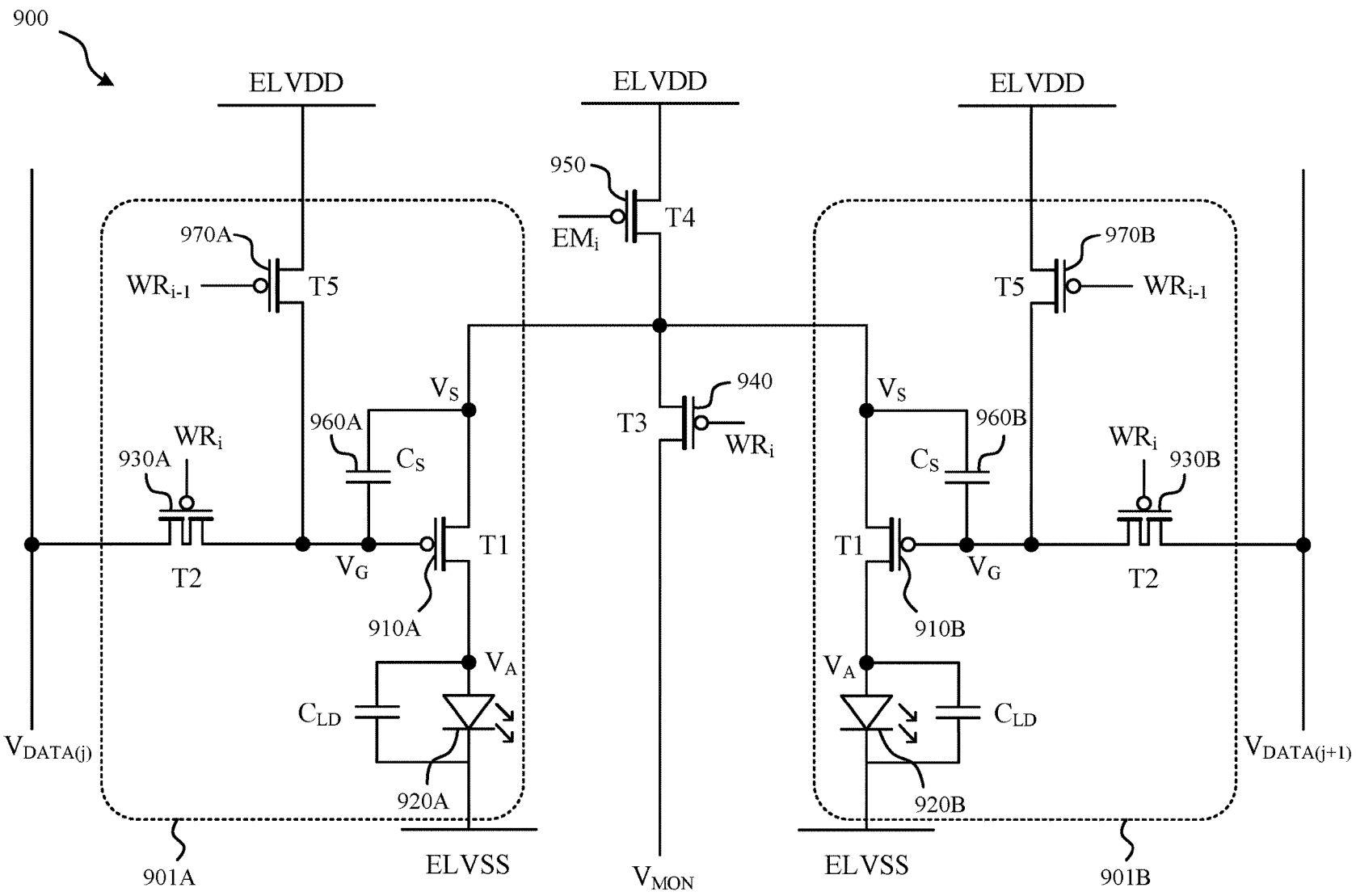
FIG. 9 is a circuit diagram illustrating a TFT sharing implementation of the 5T1C pixel circuit of FIG. 6.

With reference also to FIG. 8 and FIG. 9, an implementation of 5T1C pixel circuits 500 600 in which the second and third switch transistors are shared between two or more adjacent 5T1C pixels will now be described.

With reference to FIG. 8, a first subpixel 801A and second subpixel 801B each include the a first switch transistor 830A 830B, a driving transistor 810A 810B, a light emitting device 820A 820B, and a reset transistor 870A 870B as shown and described in association with the 5T1C pixel circuit 500 of FIG. 5. The first and second subpixels 801A 801B, however, share the node $V_S$ common and between the driving transistors 810A 810B and the storage capacitors 860A 860B. Also shared between the first and second subpixels 801A 801B, are a third switch transistor 850 (T4) coupled between the node $V_S$ and ELVDD, and a second switch transistor 840 (T3) coupled between the node $V_S$ and the monitor line $V_{MON}$. The gate terminal of the third switch transistor 850 is coupled to an emission signal line ($EM_i$) of the ith row, while the first terminal of the third switch transistor 850 is coupled to the first reference potential ELVDD, and the second terminal of the third switch transistor 850 is coupled to node $V_S$ which is common to the second terminal of the storage capacitors 860A 860B. The gate terminal of the second switch transistor 840 is coupled to a read line ($RD_i$) of the ith row, while the first terminal of the second switch transistor 840 is coupled to a monitor line ($V_{MON}$), and the second terminal of the second switch transistor 840 is also coupled to the node $V_S$.

Each of the first and second subpixels 801A 801B functions the same as the 5T1C pixel circuit 500 of FIG. 5 and according to the timing illustrated in FIG. 7 and discussed above. Utilizing the configuration of FIG. 8 in a design implementation where pixel area is limited by the TFT device count, sharing of the second and third switch transistors 840 850 between two or more adjacent sub-pixels reduces the effective device count per subpixel.

With reference to FIG. 9, a first subpixel 901A and second subpixel 901B each include a first switch transistor 930A 930B, a driving transistor 910A 910B, a light emitting device 920A 920B, and a reset transistor 970A 970B as shown and described in association with the 5T1C pixel circuit 600 of FIG. 6. The first and second subpixels 901A 901B, however, share the node $V_S$ common and between the driving transistors 910A 910B and the storage capacitors 960A 960B. Also shared between the first and second subpixels 901A 901B, are a third switch transistor 950 (T4) coupled between the node $V_S$ and ELVDD, and a second switch transistor 940 (T3) coupled between the node $V_S$ and the monitor line $V_{MON}$. The gate terminal of the third switch transistor 950 is coupled to an emission signal line ($EM_i$) of the ith row, while the first terminal of the third switch transistor 950 is coupled to the first reference potential ELVDD, and the second terminal of the third switch transistor 950 is coupled to node $V_S$ which is common to the second terminal of the storage capacitors 960A 960B. The gate terminal of the second switch transistor 940 is coupled to a write signal line ($WR_i$) of the ith row, while the first terminal of the second switch transistor 940 is coupled to a monitor line ($V_{MON}$), and the second terminal of the second switch transistor 940 is also coupled to the node $V_S$.

Each of the first and second subpixels 901A 901B functions the same as the 5T1C pixel circuit 600 of FIG. 6 and according to the timing illustrated in FIG. 7 and discussed above. Utilizing the configuration of FIG. 9 in a design implementation where pixel area is limited by the TFT device count, sharing of the second and third switch transistors 940 950 between two or more adjacent sub-pixels reduces the effective device count per subpixel. Additionally, as with the embodiment of FIG. 6, the utilization of write signal line $WR_i$ and $WR_{i-1}$ only (without the use of read lines $RD_i$ and $RD_{i-1}$) simplifies row (gate) control signals required per row of pixels of the display system 150.

Figure 10:
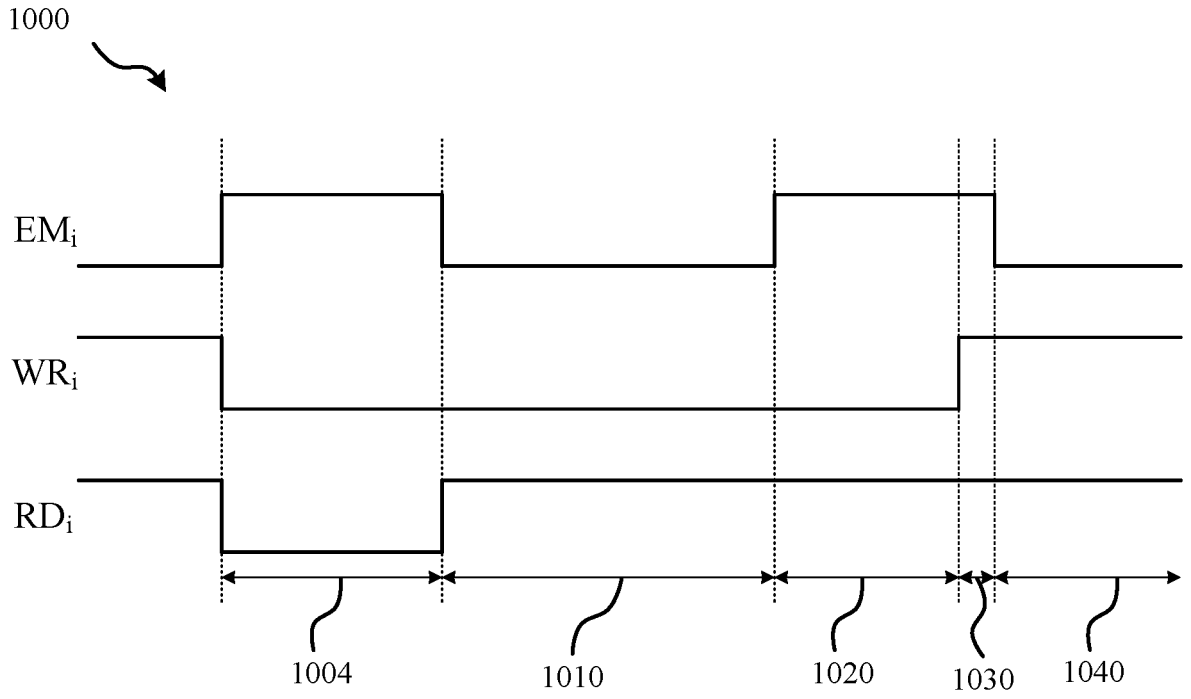
FIG. 10 is a timing diagram illustrating an alternate programming and driving of the 4T1C pixel circuit of FIG. 3.

With reference to FIG. 10, an alternate example of a display timing 1000 for the 4T1C pixel circuit 300 depicted in FIG. 3 which includes both reset and in pixel compensation will now be described. The complete display timing 1000 occurs typically once per frame and includes a rest cycle 1004, a programming cycle 1010, a compensation cycle 1020, a settling cycle 1030, and an emission cycle 1040. The write signal ($WR_i$) is held low throughout the reset, programming, and calibration cycles 1004 1010 1020, keeping the data line voltage $V_{DATA}$ coupled to $V_G$. For the embodiment of FIG. 4, the supply voltage ELVDD of the 4T1C pixel circuit 300 of FIG. 3 is controllable.

During the reset cycle 1004, the emission signal ($EM_i$) is held high while the read signal ($RD_i$) is held low ensuring the third switch transistor 350 is OFF and the second switch transistor 340 is ON exposing the node $V_S$ to the voltage on the monitor line $V_{MON}$. Also during the reset cycle 1004 the voltage on the monitor line $V_{MON}$ is set to 0 volts and the voltage of the data line is set at a pixel data level (typically 6 to 9 volts), giving rise to a negative $V_{SG}$ of 6 to 9 volts. The driving transistor 310 being negatively biased triggers the release of carriers and hence reversal of the short-term trapping of carriers, resetting the driving transistor 310 and its threshold voltage ($V_{TH}$), and mitigating hysteresis in the I-V response exhibited by the driving transistor 310 when it is programmed in the following programming cycle 1010.

During the programming cycle 1010 the read signal ($RD_i$) goes high turning OFF the second switch transistor 340 and the emission signal ($EM_i$) goes low turning ON the third switch transistor 350. The voltage ELVDD is set to a reference voltage $V_{REF}$ (similar to, for example, the reference voltage $V_{MON}$ described in association with FIG. 4, and provided on the monitor line during programming cycle 410). Since the first switch transistor 330 and the third switch transistor 350 are both ON, the voltage of the storage capacitor 360 and therefore the voltage $V_{SG}$ of the driving transistor 310 is charged to a value of $V_{REF}-V_{DATA}$. These voltages are set in accordance with a desired programming voltage for causing the pixel 300 to emit light at a desired luminance according to image data.

At the beginning of the calibration cycle 1020, the emission signal ($EM_i$) goes high to turn OFF the third switch transistor 350 to discharge some of the voltage (charge) of the storage capacitor 360 through the driving transistor 310. The amount discharged is a function of the characteristics of the driving transistor 310. For example, if the driving transistor 310 is "strong", the discharge occurs relatively quickly and relatively more charge is discharged from the storage capacitor 360 through the driving transistor 310 during the fixed duration of the calibration cycle 420. On the other hand, if the driving transistor 310 is "weak", the discharge occurs relatively slowly and relatively less charge is discharged from the storage capacitor 360 through the driving transistor 310 during the calibration cycle 1020. As a result, the voltage (charge) stored in the storage capacitor 360 ($V_P$) is reduced comparatively more for relatively strong driving transistors versus comparatively less for relatively weak driving transistors, thereby providing some compensation for non-uniformity and variations in the driving transistors across the display whether due to variations in fabrication, variations in degradation over time, or variations due to hysteresis in the temporary threshold voltage of the driving transistor 310.

After the calibration cycle 1020, a settling cycle 1030 is performed prior to the emission. During the settling cycle 1030 the second and third switch transistors 340, 350 remain OFF, while the write signal ($WR_i$) goes high to also turn OFF the first switch transistor 330. After completion of the duration of the settling cycle 1030 at the start of the emission cycle 1040, ELVDD is set to the standard positive reference ELVDD rail instead of $V_{REF}$, and the emission signal ($EM_i$) goes low turning ON the third switch transistor 350 allowing current to flow through the light emitting device 320 according to the calibrated stored voltage on the storage capacitor 360.

Driven in this manner, in conjunction with a controllable positive reference potential ELVDD, the pixel 300 circuit is capable of achieving in-pixel compensation including that related to hysteresis to a good level for high and medium grayscales, as well as performing a reset cycle for directly reducing hysteresis effects on the threshold voltage of the driving transistor 310 caused by trapped carriers, which better address low grayscale compensation required to meet high-end uniformity specifications.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A display system comprising:

an array of pixel circuits arranged in rows and columns, each pixel circuit including:

a driving transistor;

a storage capacitor coupled across a gate terminal and a first terminal of the driving transistor;

a light emitting device coupled to a second terminal of the driving transistor; and a reset switch transistor coupled between a first reference potential and a node common to a first terminal of the storage capacitor and the gate terminal of the driving transistor; and a controller for driving each pixel circuit during each frame over a plurality of operation cycles for the pixel circuit including a programming cycle for programming the storage capacitor of the pixel circuit, and a reset cycle prior to the programming cycle for resetting the driving transistor of the pixel circuit, the controller resetting the driving transistor of the pixel circuit by activating the reset switch transistor of the pixel circuit during the reset cycle to expose the node of the pixel circuit to the reference potential which causes reverse biasing across the gate and first terminal of the driving transistor.

2. The display system of claim 1 wherein the controller activates the reset switch transistor of the pixel circuit during the reset cycle of the pixel circuit with a control signal used for controlling a programming of another pixel circuit during the programming cycle of the another pixel circuit.

3. The display system of claim 2 wherein the pixel circuit is of one row other than another row of the another pixel circuit.

4. The display system of claim 3 wherein the one row and the another row are adjacent rows.

5. The display system of claim 4 wherein the controller programs the pixel circuit during the programming cycle of the pixel circuit using a write signal for the one row for controlling a first switch transistor for coupling a data line with the storage capacitor of the pixel circuit and using a read signal for the one row for controlling a second switch transistor for coupling a monitor line with the storage capacitor of the pixel circuit, wherein the control signal used for controlling the programming of the another pixel circuit is one of a write signal and a read signal for the another row.

6. The display system of claim 5 wherein the controller further is for driving each pixel circuit over a plurality of operation cycles including a compensation cycle and a settling cycle after the programming cycle, during the compensation cycle the controller using the read signal to deactivate the second switch transistor to decouple the monitor line from the storage capacitor of the pixel circuit allowing the storage capacitor to discharge through the driving transistor of the pixel circuit during the compensation cycle.

7. The display system of claim 5 further comprising a third switch transistor shared by at least a first and a second pixel circuit of the one row, wherein the second switch transistor is shared by the at least a first and a second pixel circuit, wherein the controller programs the at least a first and a second pixel circuit during the programming cycle using the read signal for the one row for controlling the shared second switch transistor for coupling the monitor line with the storage capacitors of the at least a first and a second pixel circuit, wherein the controller further is for driving each pixel circuit over a plurality of operation cycles including an emission cycle after the programming cycle, during the emission cycle the controller using an emission signal line to control the third switch transistor to couple the driving transistors of the at least a first and a second pixel circuit to the first reference potential.

8. The display system of claim 4 wherein the controller programs the pixel circuit during the programming cycle of the first circuit using a write signal for the one row for controlling a first switch transistor for coupling a data line with the storage capacitor of the pixel circuit and for controlling a second switch transistor for coupling a monitor line with the storage capacitor of the pixel circuit, wherein the control signal used for controlling the programming of the another pixel is a write signal for the another row.

9. The display system of claim 8 further comprising a third switch transistor shared by at least a first and a second pixel circuit of the one row, wherein the second switch transistor is shared by the at least a first and a second pixel circuit, wherein the controller further is for driving each pixel circuit over a plurality of operation cycles including an emission cycle after the programming cycle, during the emission cycle the controller using an emission signal line to control the third switch transistor to couple the driving transistors of the at least a first and a second pixel circuit to the first reference potential.

10. A method of driving a display system, the display system including an array of pixel circuits arranged in rows and columns, each pixel circuit including:

a driving transistor;

a storage capacitor coupled across a gate terminal and a first terminal of the driving transistor;

a light emitting device coupled to a second terminal of the driving transistor; and a reset switch transistor coupled between a first reference potential and a node common to a first terminal of the storage capacitor and the gate terminal of the driving transistor; the method comprising:

driving each pixel circuit during each frame over a plurality of operation cycles for the pixel circuit including a programming cycle and a reset cycle, comprising:

during the programming cycle, programming the storage capacitor of the pixel circuit, and during a reset cycle prior to the programming cycle, resetting the driving transistor of the pixel circuit by activating the reset switch transistor of the pixel circuit during the reset cycle to expose the node of the pixel circuit to the reference potential which causes reverse biasing across the gate and first terminal of the driving transistor.

11. The method of claim 10 wherein resetting the driving transistor comprises activating the reset switch transistor of the pixel circuit with a control signal used for controlling a programming of another pixel circuit during the programming cycle of the another pixel circuit.

12. The method of claim 11 wherein the pixel circuit is of one row other than another row of the another pixel circuit.

13. The method of claim 12 wherein the one row and the another row are adjacent rows.

14. The method of claim 13 further comprising, programming the pixel circuit during the programming cycle using a write signal for the one row for controlling a first switch transistor for coupling a data line with the storage capacitor of the pixel circuit and using a read signal for the one row for controlling a second switch transistor for coupling a monitor line with the storage capacitor of the pixel circuit, wherein the control signal used for controlling the programming of the another pixel circuit is one of a write signal and a read signal for the another row.

15. The method of claim 14 wherein the plurality of operation cycles includes a compensation cycle and a settling cycle, wherein driving each pixel circuit further comprises after the programming cycle, during compensation cycle, deactivating the second switch transistor using the read signal to decouple the monitor line from the storage capacitor of the pixel circuit allowing the storage capacitor to discharge through the driving transistor of the pixel circuit during the compensation cycle.

16. The method of claim 13 further comprising, programming the pixel circuit during the programming cycle using a write signal for the one row for controlling a first switch transistor for coupling a data line with the storage capacitor of the pixel circuit and for controlling a second switch transistor for coupling a monitor line with the storage capacitor of the pixel circuit, wherein the control signal used for controlling the programming of the another pixel is a write signal for the another row.

17. A display system comprising:

an array of pixel circuits arranged in rows and columns, each pixel circuit including:

a driving transistor;

a storage capacitor coupled across a gate terminal and a first terminal of the driving transistor;

a light emitting device coupled to a second terminal of the driving transistor; and a switch transistor coupled between a reference voltage and a node common to a first terminal of the storage capacitor and the first terminal of the driving transistor; and a controller for driving each pixel circuit during each frame over a plurality of operation cycles for the pixel circuit including a programming cycle for programming the storage capacitor of the pixel circuit, and a reset cycle prior to the programming cycle for resetting the driving transistor of the pixel circuit, the controller resetting the driving transistor of the pixel circuit by activating the switch transistor of the pixel circuit during the reset cycle to expose the node of the pixel circuit to the reference voltage which is set to a voltage to cause reverse biasing across the gate and first terminal of the driving transistor.

18. The display system of claim 17 wherein the controller programs the pixel circuit during the programming cycle of the pixel circuit by deactivating the switch transistor, activating a first switch transistor for coupling a data line with the storage capacitor and the gate terminal of the driving transistor of the pixel circuit and activating a second switch transistor for coupling a controllable reference potential with the node of the pixel circuit.

19. The display system of claim 18 wherein the controller further is for driving each pixel circuit over a plurality of operation cycles including a compensation cycle and a settling cycle after the programming cycle, during the compensation cycle the controller deactivating the second switch transistor to decouple the controllable reference potential from the node of the pixel circuit allowing the storage capacitor to discharge through the driving transistor of the pixel circuit during the compensation cycle.

20. A method of driving a display system, the display system including an array of pixel circuits arranged in rows and columns, each pixel circuit including:

a driving transistor;

a storage capacitor coupled across a gate terminal and a first terminal of the driving transistor;

a light emitting device coupled to a second terminal of the driving transistor; and a switch transistor coupled between a reference voltage and a node common to a first terminal of the storage capacitor and the first terminal of the driving transistor; the method comprising:

driving each pixel circuit during each frame over a plurality of operation cycles for the pixel circuit including a programming cycle and a reset cycle, comprising: during the programming cycle, programming the storage capacitor of the pixel circuit, and during a reset cycle prior to the programming cycle, resetting the driving transistor of the pixel circuit by activating the switch transistor of the pixel circuit during the reset cycle to expose the node of the pixel circuit to the reference voltage which is set to a voltage to cause reverse biasing across the gate and first terminal of the driving transistor.

21. The method of claim 20 further comprising, programming the pixel circuit during the programming cycle by deactivating the switch transistor, activating a first switch transistor for coupling a data line with the storage capacitor and the gate terminal of the driving transistor of the pixel circuit, and activating a second switch transistor for coupling a controllable reference potential with the node of the pixel circuit.

22. The method of claim 21 wherein the plurality of operation cycles includes a compensation cycle and a settling cycle, wherein driving each pixel circuit further comprises after the programming cycle, during the compensation cycle, deactivating the second switch transistor to decouple the controllable reference potential from the node of the pixel circuit allowing the storage capacitor to discharge through the driving transistor of the pixel circuit during the compensation cycle.

* * * * *